US010468751B2

(12) United States Patent
Na et al.

(10) Patent No.: US 10,468,751 B2
(45) Date of Patent: Nov. 5, 2019

(54) MULTI-FEED ANTENNA ASSEMBLY

(71) Applicant: GALTRONICS USA, INC., Tempe, AZ (US)

(72) Inventors: Jongmin Na, Gyeong-gi-do (KR); Taihong Kim, Gyeong-gi-do (KR); Eungyu Bae, Gyeong-gi-do (KR); Matti Martiskainen, Tiberias (IL)

(73) Assignee: GALTRONICS USA, INC., Tempe, AZ (US)

( * ) Notice: Subject to any disclaimer, the term of this patent is extended or adjusted under 35 U.S.C. 154(b) by 509 days.

(21) Appl. No.: 15/121,711

(22) PCT Filed: Feb. 26, 2014

(86) PCT No.: PCT/IL2014/050199

§ 371 (c)(1),
(2) Date: Aug. 25, 2016

(87) PCT Pub. No.: WO2015/128856

PCT Pub. Date: Sep. 3, 2015

(65) Prior Publication Data

US 2016/0365622 A1 Dec. 15, 2016

(51) Int. Cl.

| | |
|---|---|
| ***H01Q 1/48*** | (2006.01) |
| ***H01Q 1/24*** | (2006.01) |
| ***H01Q 7/00*** | (2006.01) |
| ***H01Q 9/42*** | (2006.01) |
| ***H01Q 21/30*** | (2006.01) |
| ***H01Q 5/35*** | (2015.01) |
| ***H01Q 5/371*** | (2015.01) |
| ***H01Q 1/50*** | (2006.01) |
| ***H01Q 9/04*** | (2006.01) |

(52) U.S. Cl.

CPC ..... *H01Q 1/243* (2013.01); *H01Q 1/48* (2013.01); *H01Q 1/50* (2013.01); *H01Q 5/35* (2015.01); *H01Q 5/371* (2015.01); *H01Q 7/00* (2013.01); *H01Q 9/0407* (2013.01); *H01Q 9/42* (2013.01); *H01Q 21/30* (2013.01)

(58) Field of Classification Search

CPC .. H01Q 1/24; H01Q 5/35; H01Q 5/37; H01Q 1/48; H01Q 1/50; H01Q 7/00; H01Q 9/04; H01Q 9/42; H01Q 21/30

USPC ..... 343/702

See application file for complete search history.

(56) References Cited

U.S. PATENT DOCUMENTS 7,911,392 B2 * 3/2011 Rao ..... H01Q 1/243 343/700 MS

2006/0244665 A1 11/2006 Tung (Continued)

OTHER PUBLICATIONS

International Searching Authority, The International Search Report and the Written Opinion of the International Searching Authority, or the Declaration, dated Jun. 10, 2014.

*Primary Examiner* — Andrea Lindgren Baltzell
(74) *Attorney, Agent, or Firm* — Brion Raffoul

(57) ABSTRACT

A multi-feed antenna assembly including a ground element lying in a plane, a first antenna element coupled to the ground element and having a projection on the plane, a first feed for feeding the first antenna element, a second antenna element coupled to the ground element and having a projection on the plane, the projection of the second antenna element being at least partially encompassed by the projection of the first antenna element and a second feed for feeding the second antenna element.

22 Claims, 27 Drawing Sheets

(56) References Cited

U.S. PATENT DOCUMENTS

| | | | | |
|---|---|---|---|---|
| 2008/0287171 | A1 | 11/2008 | Qi et al. | |
| 2009/0085813 | A1* | 4/2009 | Wang | H01Q 1/243 343/702 |
| 2012/0206302 | A1 | 8/2012 | Ramachandran et al. | |
| 2013/0335278 | A1* | 12/2013 | Lin | H01Q 1/22 343/702 |

* cited by examiner

MULTI-FEED ANTENNA ASSEMBLY

CROSS-REFERENCE TO RELATED APPLICATIONS

This application is a U.S. National-Stage entry under 35 U.S.C. § 371 based on International Application No. PCT/IL2014/050199, filed Feb. 26, 2014, which was published under PCT Article 21(2) and which is hereby incorporated in its entirety by reference.

FIELD OF THE INVENTION

The present invention relates generally to antennas and more particularly to antennas having multiple feeds.

BACKGROUND OF THE INVENTION

Various types of multiple feed antennas are known in the art.

SUMMARY OF THE INVENTION

The present invention seeks to provide improved highly compact multiple feed antenna assemblies for use in wireless devices.

There is thus provided in accordance with a preferred embodiment of the present invention a multi-feed antenna assembly including a ground element lying in a plane, a first antenna element coupled to the ground element and having a projection on the plane, a first feed for feeding the first antenna element, a second antenna element coupled to the ground element and having a projection on the plane, the projection of the second antenna element being at least partially encompassed by the projection of the first antenna element and a second feed for feeding the second antenna element.

In accordance with a preferred embodiment of the present invention, the first antenna element includes a PIFA antenna element and the second antenna element includes a coupling antenna element.

Alternatively, the first antenna element includes a coupling antenna element and the second antenna element includes a PIFA antenna element.

In accordance with another preferred embodiment of the present invention, the first antenna element includes a monopole antenna element and the second antenna element includes a PIFA antenna element.

Preferably, the first and second antenna elements are disposed on a common surface of a non-conductive carrier.

Alternatively, the first and second antenna elements are disposed on different respective surfaces of a non-conductive carrier.

In accordance with a further preferred embodiment of the present invention, the first antenna element includes at least one loop antenna element.

Preferably, the second antenna element is fully encompassed by the at least one loop antenna element.

Preferably, the first antenna element is at least partially formed by a conductive frame of a wireless device.

In accordance with still another preferred embodiment of the present invention, the second antenna element includes a loop antenna element.

Preferably, the second antenna element is at least partially formed by a conductive frame of a wireless device.

Preferably, the second antenna element is stacked upon the first antenna element.

Preferably, the conductive frame includes an upper segment and a lower segment, the first antenna element being at least partially formed by the upper segment and the second antenna element being at least partially formed by the lower segment.

Preferably, the upper segment includes a first gap and the lower segment includes a second gap, the first gap forming a terminus of the first antenna element and the second gap forming a terminus of the second antenna element.

Preferably, the first and second gaps are located on opposite sides of the conductive frame.

Preferably, the first antenna element resonates in a first frequency band and the second antenna element resonates in a second frequency band.

Preferably, the first frequency band overlaps with the second frequency band.

There is further provided in accordance with another preferred embodiment of the present invention a multi-feed antenna assembly including a ground element lying in a plane, at least one first loop antenna element coupled to the ground element and having a projection on the plane, a first feed for feeding the at least one first loop antenna element, a second antenna element coupled to the ground element and having a projection on the plane, the projection of the second antenna element being enclosed by the projection of the at least one first loop antenna element and a second feed for feeding the second antenna element.

There is additionally provided in accordance with a further preferred embodiment of the present invention a wireless device including a device body having a periphery, a conductive frame surrounding the periphery, the conductive frame having an upper segment and a lower segment, a ground element disposed within the periphery and lying in a plane, a first antenna element coupled to the ground element and having a projection on the plane, the first antenna element being partially formed by the upper segment, a first feed for feeding the first antenna element, a second antenna element coupled to the ground element and having a projection on the plane, the projection of the second antenna element being partially enclosed by the projection of the first antenna element, the second antenna element being partially formed by the lower segment and a second feed for feeding the second antenna element.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
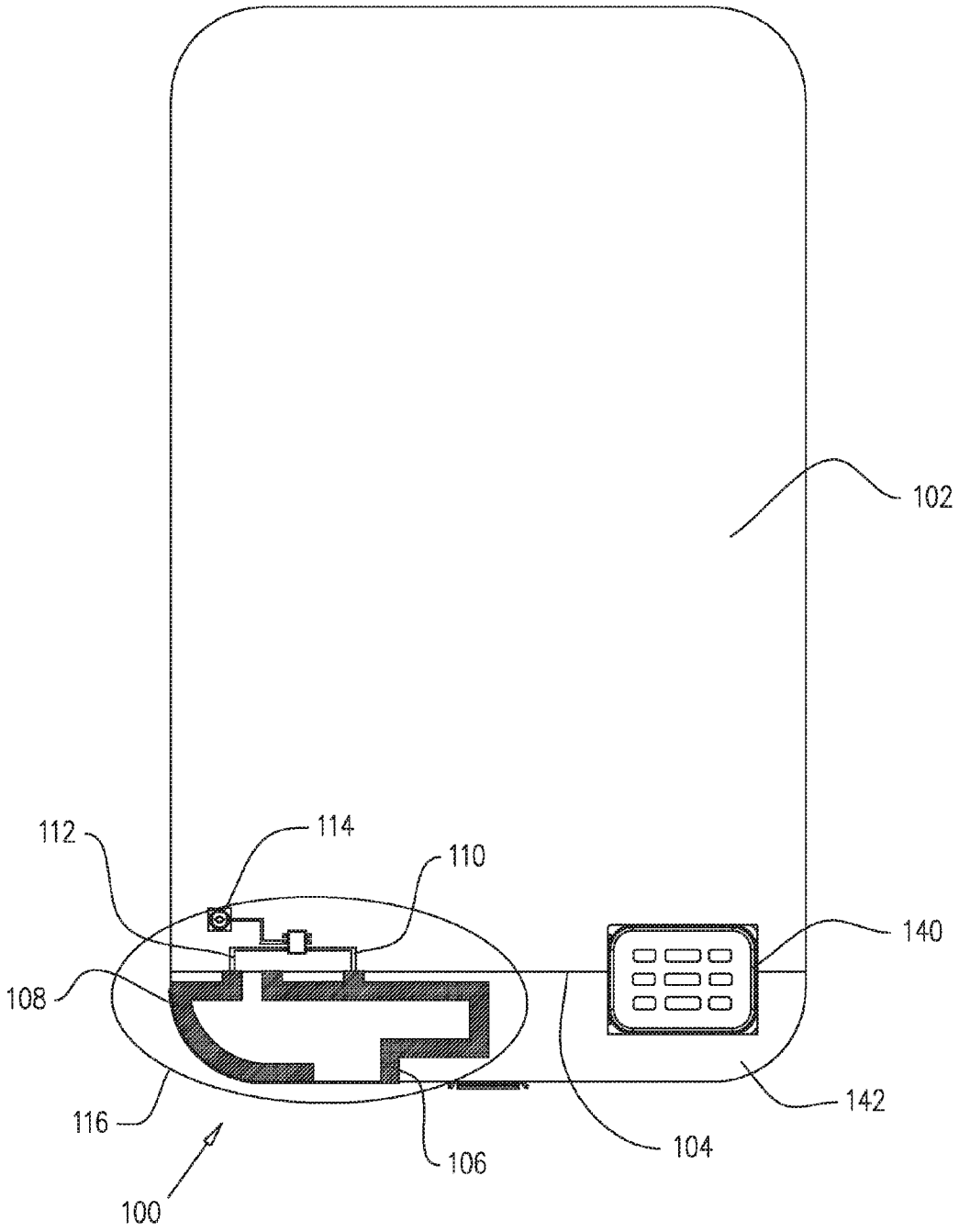
FIGS. 1A, 1B, 1C and 1D are simplified respective first and second top and posterior and anterior perspective view illustrations of an antenna assembly constructed and operative in accordance with a preferred embodiment of the present invention.

Reference is now made to FIGS. 1A, 1B, 1C and 1D which are simplified respective first and second top and posterior and anterior perspective view illustrations of an antenna assembly constructed and operative in accordance with a preferred embodiment of the present invention.

As seen in FIGS. 1A-1D, there is provided an antenna assembly 100, including a ground element 102 having an edge 104. As seen most clearly in FIG. 1A, ground element 102 preferably lies in a plane defined thereby. In the illustrated embodiment of ground element 102 shown in FIGS. 1A-1D, ground element 102 is shown to be a planar element, the entirety of which lies in a single plane. It is appreciated, however, that ground element 102 may alternatively comprise non-planar portions, which non-planar portions may extend beyond the plane defined by ground element 102.

A first antenna element 106 and a second antenna element 108 are preferably provided adjacent to edge 104. First antenna element 106 preferably comprises a multi-planar meandering element and second antenna element 108 preferably comprises a crescent-like element, preferably located adjacent to first antenna element 106. First antenna element 106 is preferably fed by way of a first feed connection 110 and second antenna element 108 is preferably fed by way of a second feed connection 112. First and second feed connections 110 and 112 preferably each terminate at a radio-frequency (RF) connector 114, wherefrom first and second feed connections 110 and 112 preferably receive an RF signal. In the embodiment of antenna assembly 100 illustrated in FIGS. 1A-1D RF connector 114 is shown to be located upon ground element 102. It is appreciated, however, that RF connector may alternatively be located offset from ground element 102, depending on the design requirements of a wireless device within which antenna assembly 100 may be incorporated.

Figure 1B:
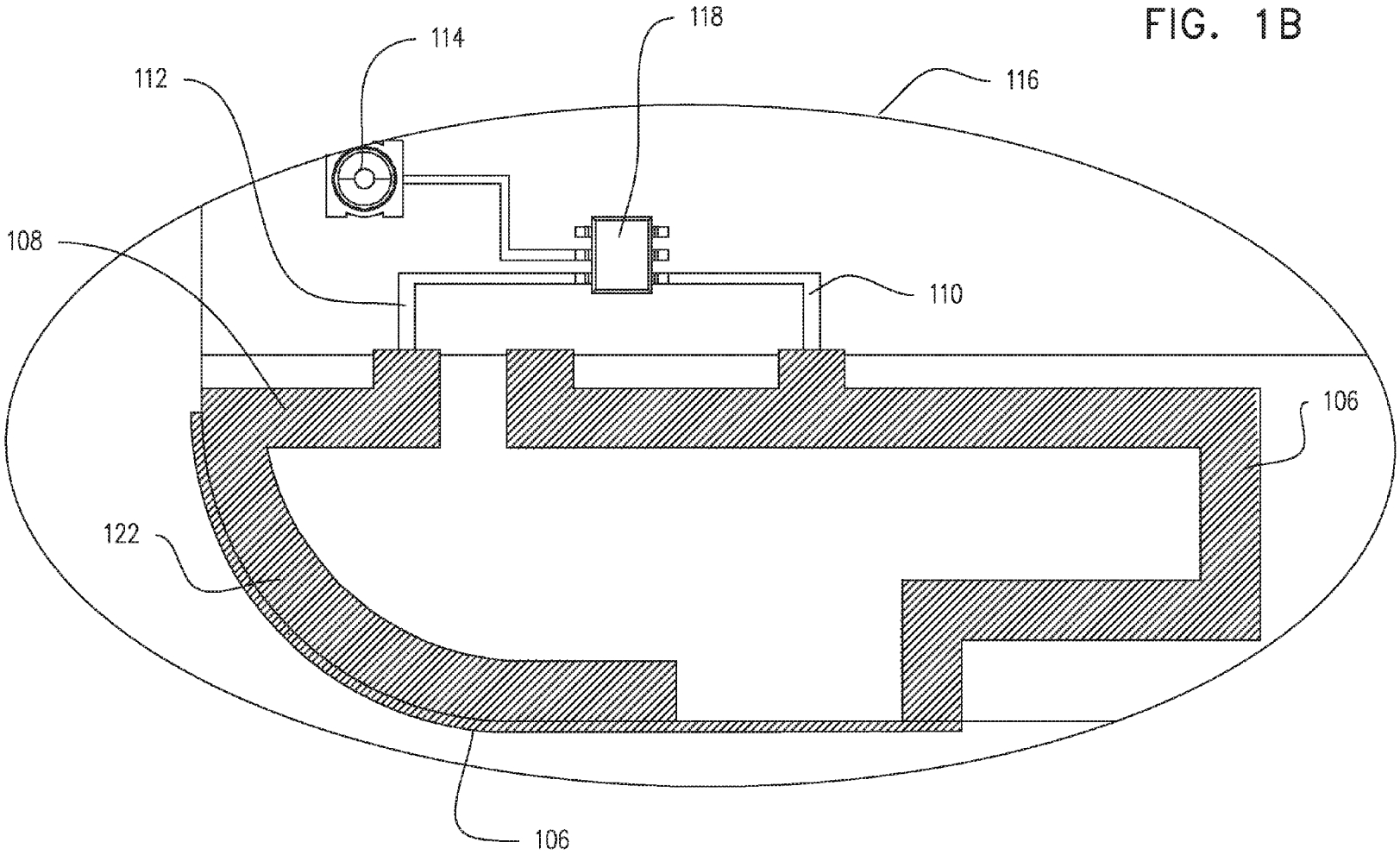
Figure 1C:
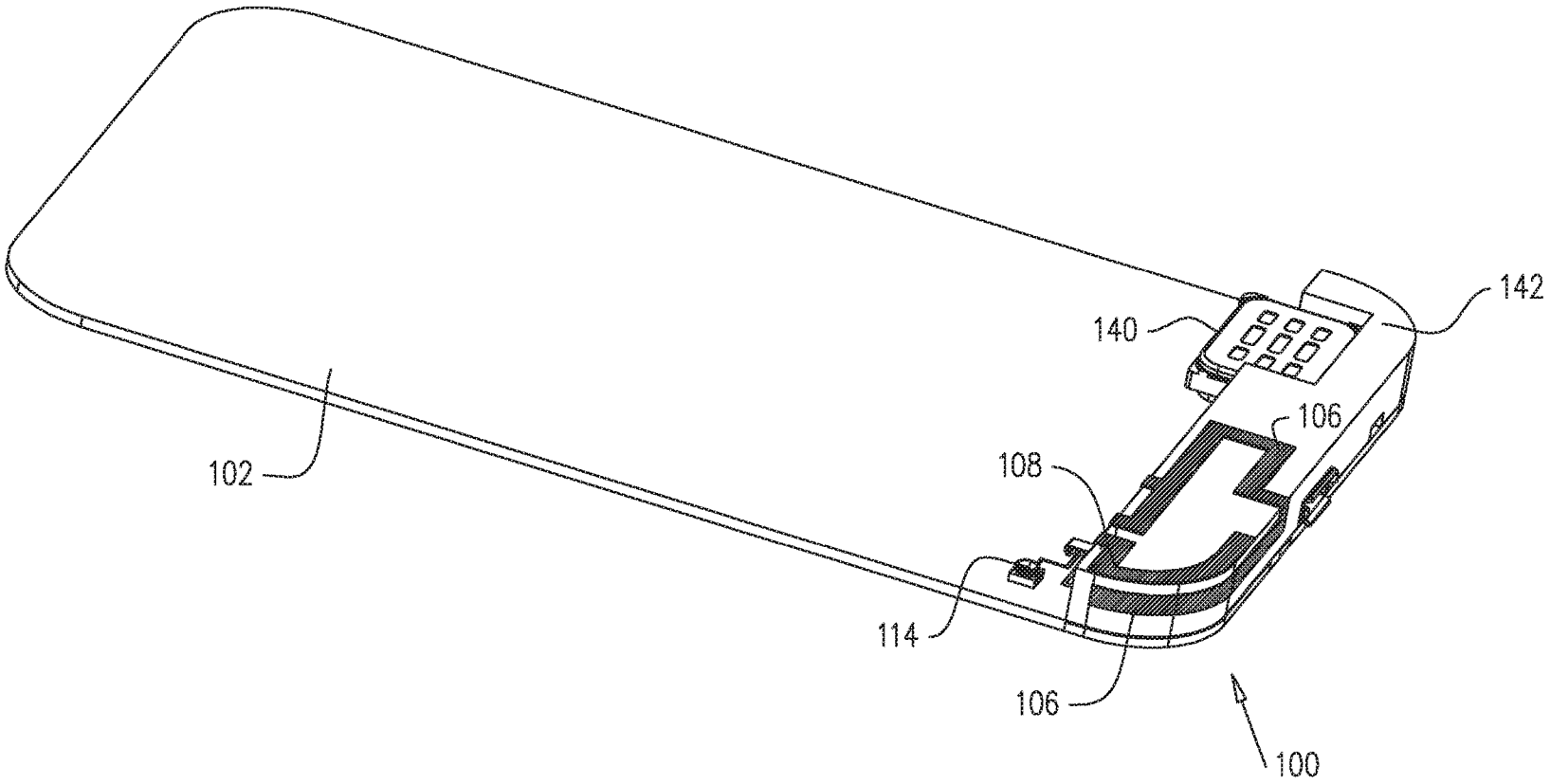
Figure 1D:
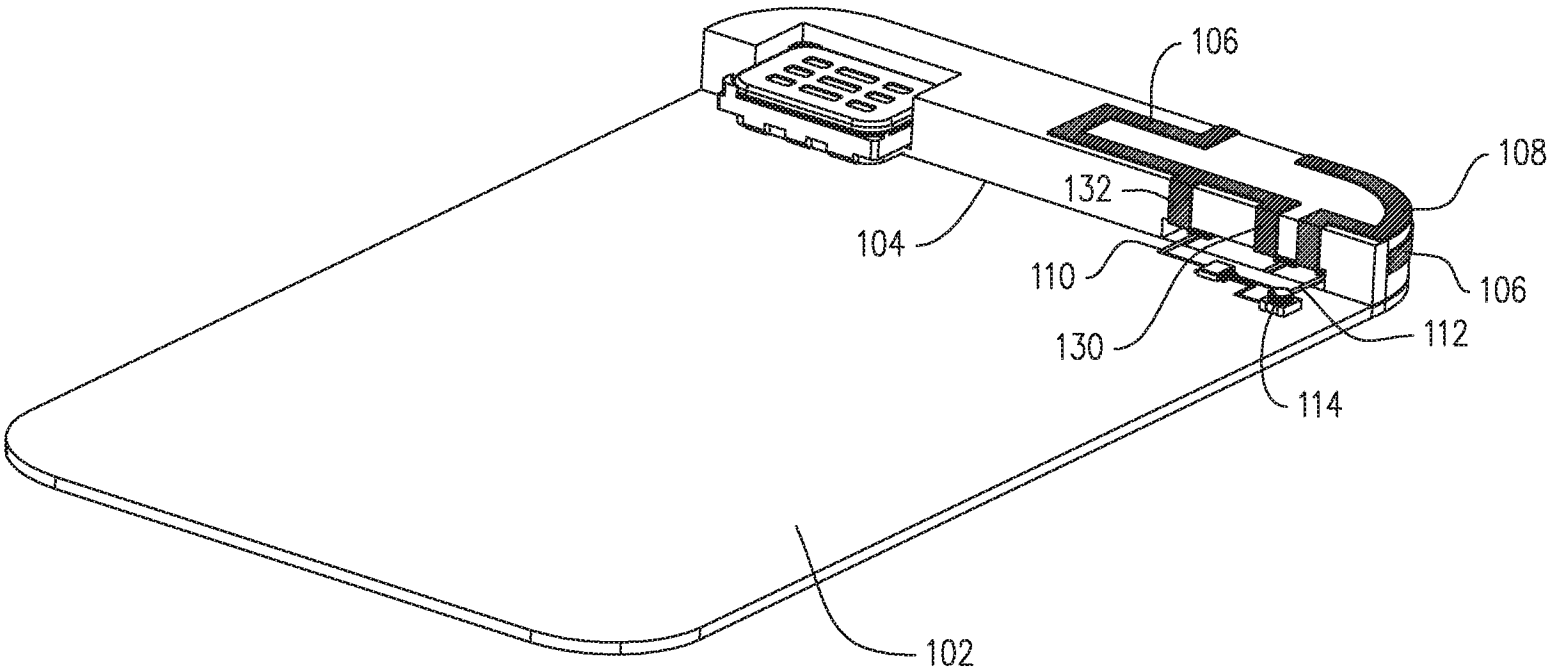

As seen most clearly at an enlargement 116 in FIG. 1B, first and second feed connections 110 and 112 are preferably each formed by conductive striplines respectively galvanically connected to first and second antenna elements 106 and 108. It is appreciated, however, that first and second feed connections 110 and 112 may alternatively be formed by a variety of other feed lines, which feed lines may be galvanically or capacitively connected to first and second antenna elements 106 and 108, as is well known in the art.

It is appreciated that as a result of first and second antenna elements 106 and 108 being respectively individually fed by first and second feed connections 110 and 112, antenna assembly 100 may be termed a multi-feed antenna assembly. A switch 118 is preferably provided at a junction of first and second feed connections 110 and 112 for switching therebetween.

As best appreciated from consideration of enlargement 116, first and second antenna elements 106 and 108 each have a projection on the plane defined by ground element 102. It is understood that the projection of first and second antenna elements 106 and 108 on the plane defined by ground element 102 includes the orthogonal transformation of all points along first and second antenna elements 106 and 108 onto the plane defined by ground element 102.

It is a particular feature of a preferred embodiment of the present invention that the projection of second antenna element 108 on the plane defined by ground element 102 is at least partially encompassed by the projection of first antenna element 106 on the plane defined by ground element 102. Here, by way of example, a projection of first antenna element 106 preferably encompasses a projection of a portion 122 of second antenna element 108. The encompassment of a portion of a projection of second antenna element 108 by a projection of first antenna element 106, wherein the projections of first and second antenna elements 106 and 108 lie on a common plane, is a particularly advantageous feature of the present invention and is in contrast to conventional multi-feed antenna assemblies, in which multiple antenna elements fed by individual respective feed connections are typically mutually spatially offset so as to avoid an overlap of the respective projections thereof.

As a result of the encompassment of a portion of a projection of second antenna element 108 by a projection of first antenna element 106, wherein the projections of first and second antenna elements 106 and 108 lie on a common plane, multi-feed antenna assembly 100 is extremely compact and occupies only a minimal volume within a wireless device in which antenna assembly 100 may be incorporated.

In operation of antenna assembly 100, switch 118 may be configured so as to allow an RF signal to be delivered to first antenna element 106 by way of first feed connection 110, or to second antenna element 108 by way of second feed connection 112. Antenna assembly 100 thus has two modes of operation, in which modes first antenna element 106 and second antenna element 108 alternatively comprise the fed antenna element.

When switch 118 is configured so as to allow an RF signal to be delivered from RF connector 114 to first antenna element 106 by way of first feed connection 110, antenna element 106 preferably acts as a radiating element, preferably resonating in a first frequency band. Antenna element 106 is preferably coupled to ground element 102 by way of a grounding stub 130, preferably located offset from and generally parallel to a feeding stub 132, to which feeding stub 132 feed connection 110 is preferably connected, as seen most clearly in FIG. 1D. It will be readily understood by one skilled in the art that antenna element 106 thus constitutes a PIFA antenna element. In this mode of operation of antenna assembly 100, second antenna element 108 is inactive and does not participate as a radiating element.

When switch 118 is configured so as to allow an RF signal to be delivered from RF connector 114 to second antenna element 108 by way of second feed connection 112, second antenna element 108 preferably acts as a coupling element, preferably coupling RF radiation to first antenna element 106, which first antenna element 106 preferably acts as a ground element with respect to second antenna element 108. Second antenna element 108 is thus preferably coupled to ground element 102 by way of first antenna element 106. In this mode of operation of antenna assembly 100, both first and second antenna elements 106 and 108 constitute active radiating elements, preferably radiating in a second frequency band.

The second frequency band of operation of antenna assembly 100, arising due to the coupling between second antenna element 108 and first antenna element 106, is preferably offset in the frequency domain from the first frequency band of operation of antenna assembly 100, arising due to the operation of first antenna element 106 as a PIFA antenna. Antenna assembly 100 thus constitutes a multiband antenna assembly.

It is a particularly advantageous feature of a preferred embodiment of the present invention that antenna assembly 100 may operate as a multiband antenna assembly, despite its individual antenna elements 106 and 108 being contained within a relatively small, overlapping volume. Antenna assembly 100 is thus particularly well-suited for inclusion in a hand-held wireless device, which hand-held wireless device may contain additional functional elements, such as, by way of example only, a speaker 140.

In the embodiment of antenna assembly 100 illustrated in FIGS. 1A-1D, portions of first and second antenna elements 106 and 108 are seen to be disposed on a common surface of a non-conductive antenna carrier 142. It is appreciated, however, that first and second antenna elements 106 and 108 may alternatively comprise portions disposed on multiple surfaces of an antenna carrier, as will be described henceforth with reference to FIGS. 3A-3D.

It is further appreciated that the particular illustrated configurations of first antenna element 106 and second antenna element 108 are exemplary only and that the topology and relative placement of first and second antenna elements 106 and 108 may be modified, provided that a projection of second antenna element 108 on the plane defined by ground element 102 remains at least partially encompassed by a projection of first antenna element 106 on that plane.

Reference is now made to FIGS. 2A, 2B, 2C and 2D, which are simplified respective first and second top and posterior and anterior perspective view illustrations of an antenna assembly constructed and operative in accordance with a preferred embodiment of the present invention.

As seen in FIGS. 2A-2D, there is provided an antenna assembly 200, including a ground element 202 having an edge 204. As seen most clearly in FIG. 2A, ground element 202 preferably lies in a plane defined thereby. In the illustrated embodiment of ground element 202 shown in FIGS. 2A-2D, ground element 202 is shown to be a planar element, the entirety of which lies in a single plane. It is appreciated, however, that ground element 202 may alternatively comprise non-planar portions, which non-planar portions may extend beyond the plane defined by ground element 202.

A first antenna element 206 and a second antenna element 208 are preferably provided adjacent to edge 204 and coupled thereto. First antenna element 206 preferably comprises a multi-planar crescent-like element and second antenna element 208 preferably comprises meandering element, preferably located adjacent to first antenna element 206. First antenna element 206 is preferably fed by way of a first feed connection 210 and second antenna element 208 is preferably fed by way of a second feed connection 212. First and second feed connections 210 and 212 preferably each terminate at an RF connector 214, wherefrom first and second feed connections 210 and 212 preferably receive an RF signal. In the embodiment of antenna assembly 200 illustrated in FIGS. 2A-2D RF connector 214 is shown to be located upon ground element 202. It is appreciated, however, that RF connector may alternatively be located offset from ground element 202, depending on the design requirements of a wireless device within which antenna assembly 200 is incorporated.

Figure 2A:
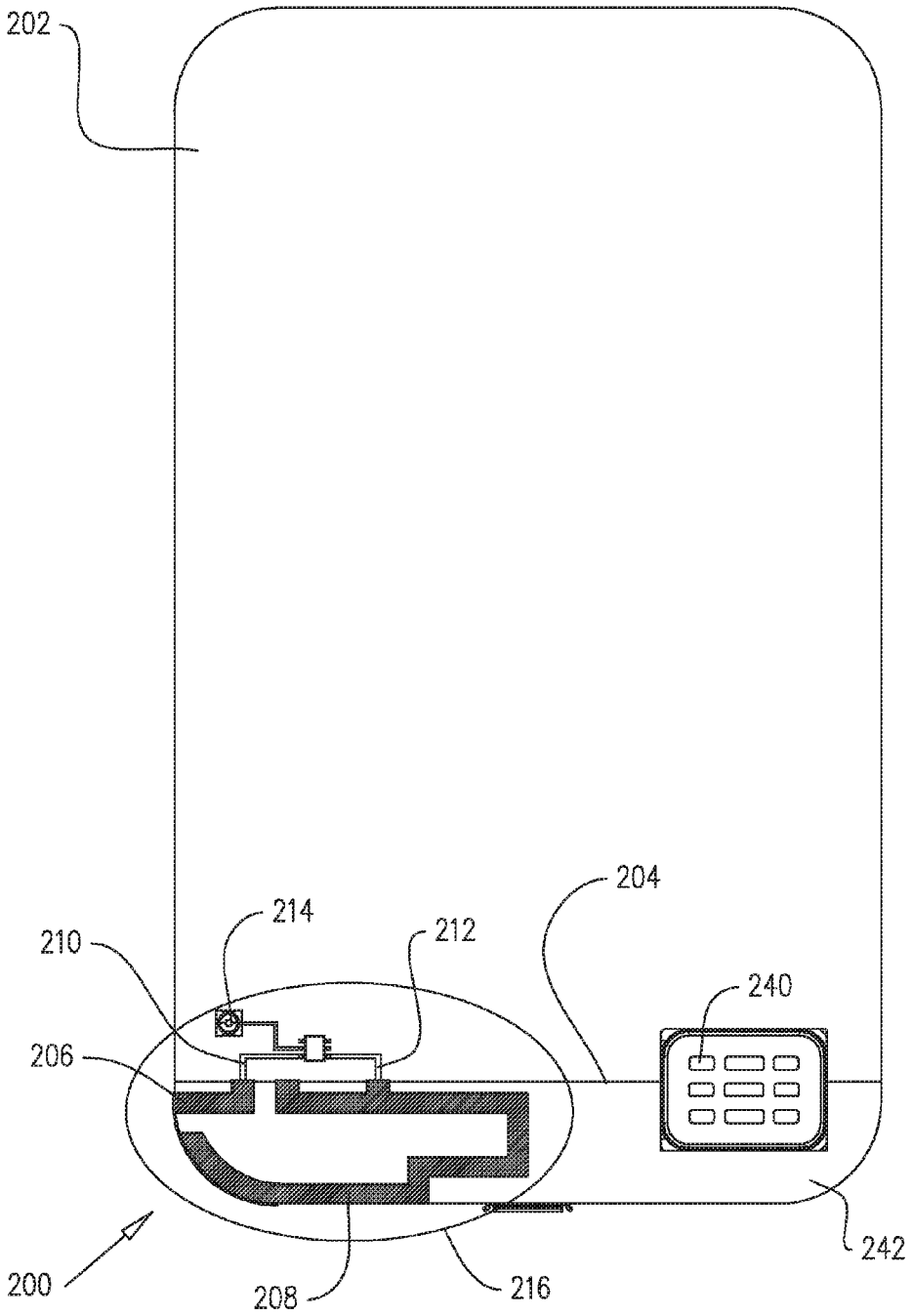
FIGS. 2A, 2B, 2C and 2D are simplified respective first and second top and posterior and anterior perspective view illustrations of an antenna assembly constructed and operative in accordance with another preferred embodiment of the present invention.
Figure 2B:
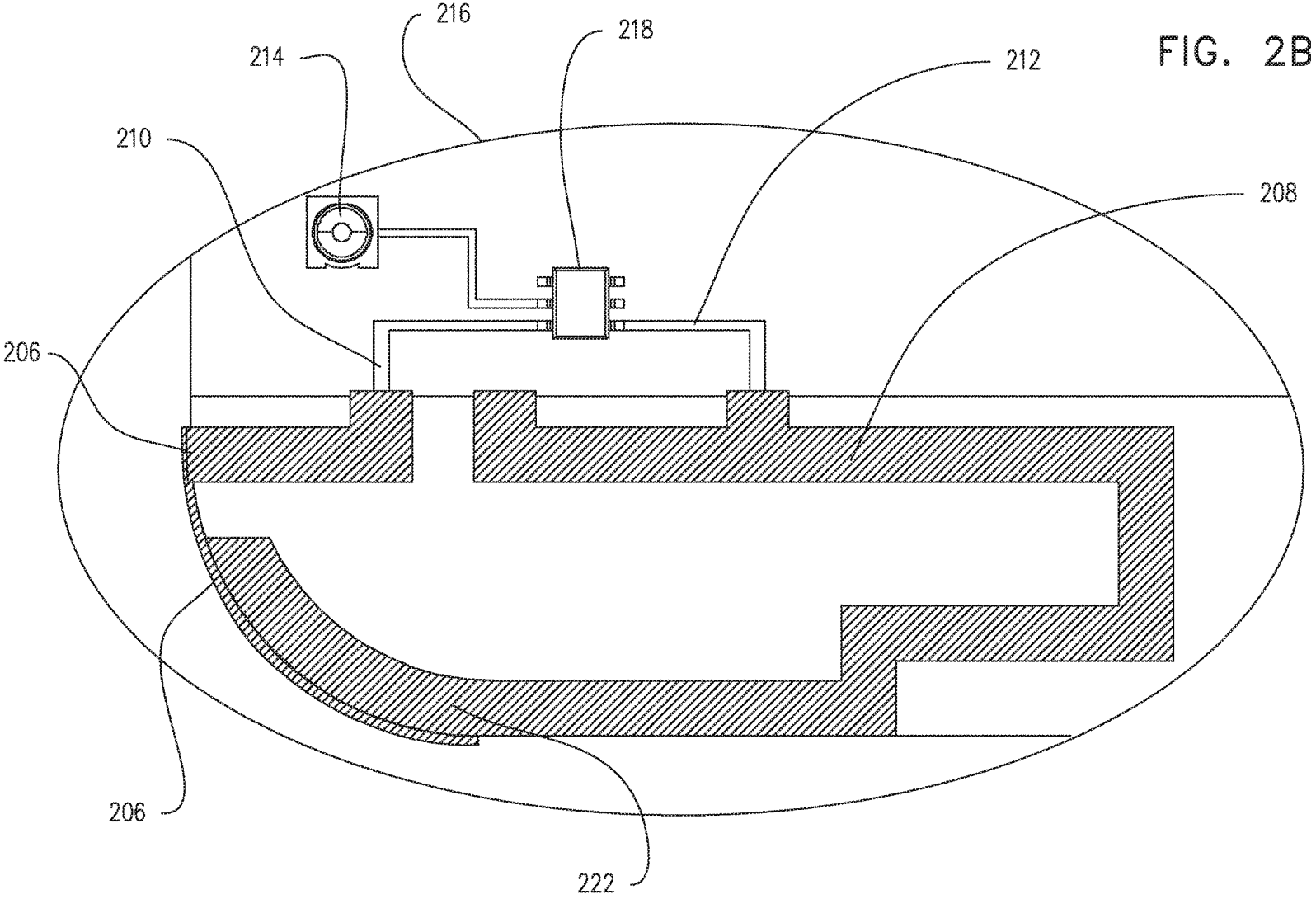
Figure 2C:
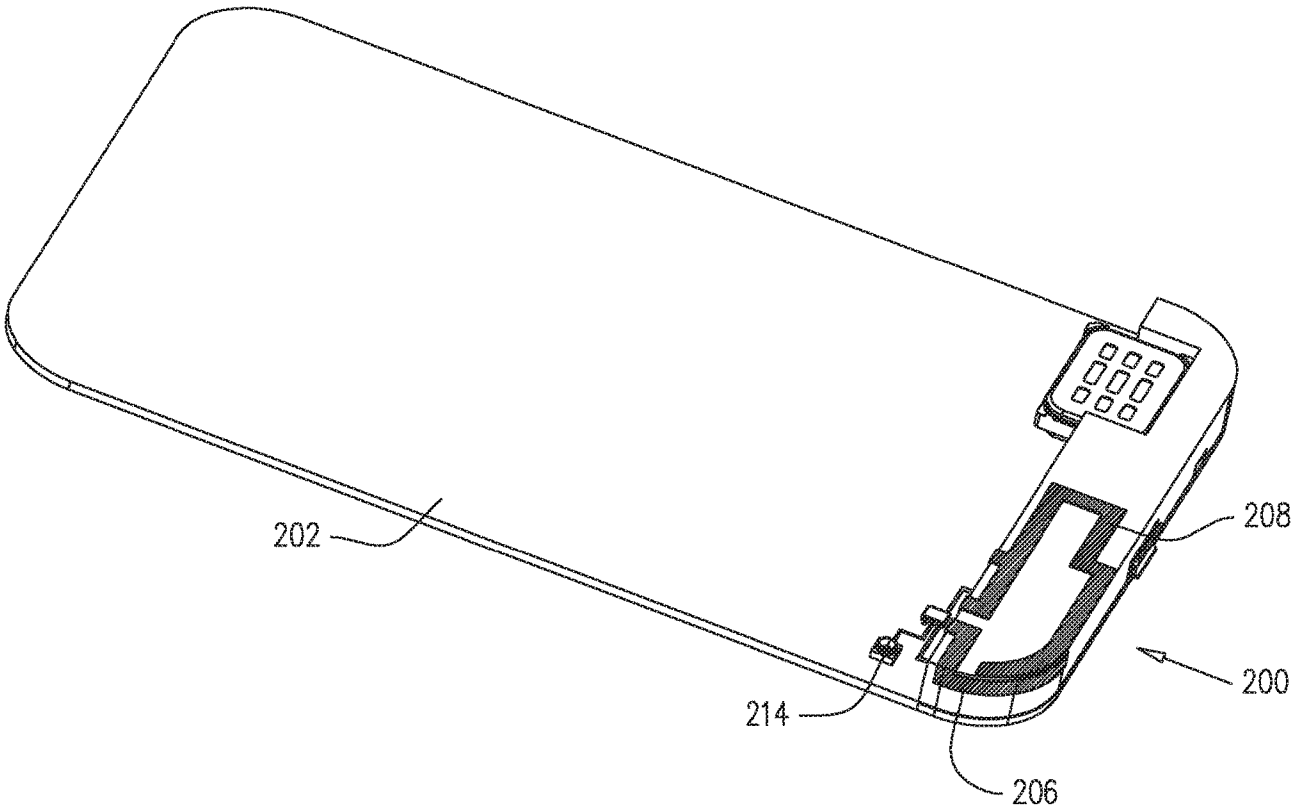
Figure 2D:
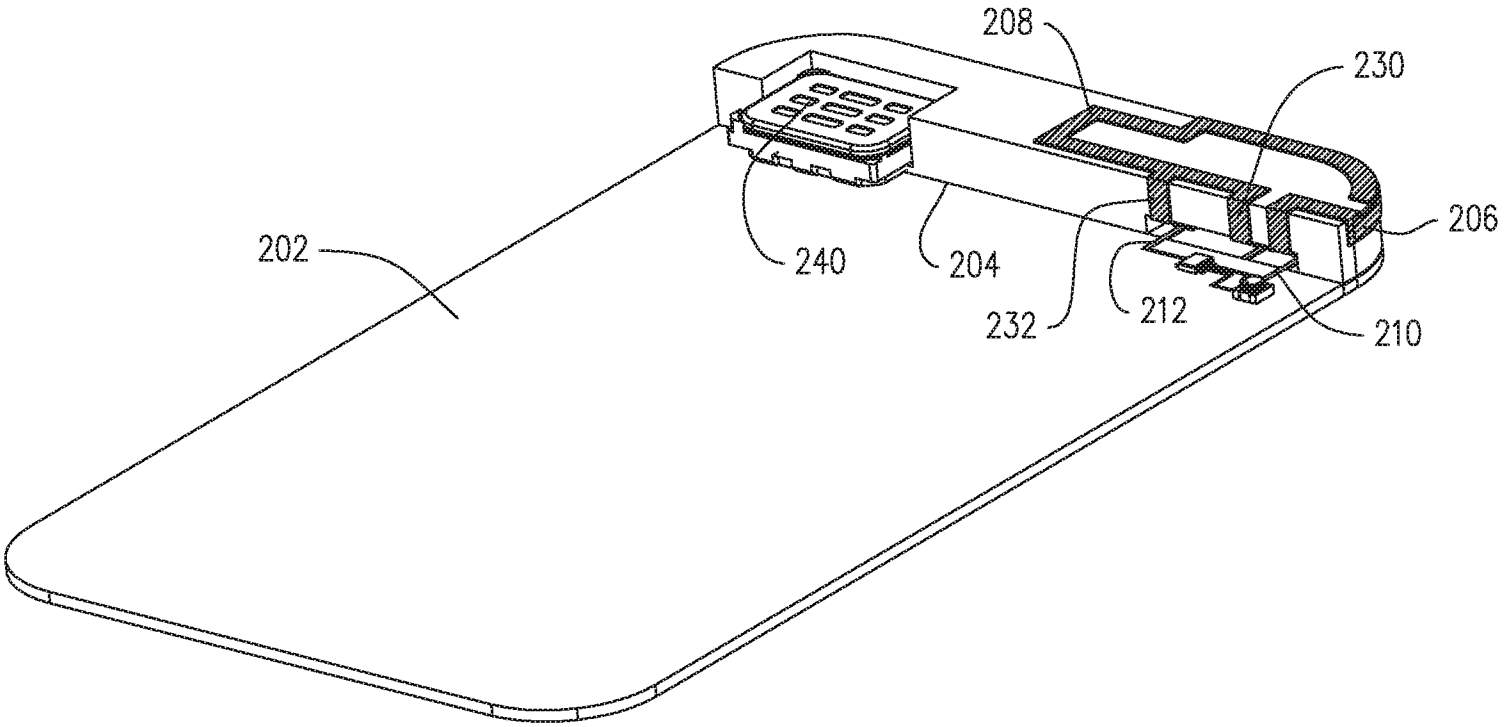

As seen most clearly at an enlargement 216 in FIG. 2B, first and second feed connections 210 and 212 are preferably each formed by conductive striplines respectively galvanically connected to first and second antenna elements 206 and 208. It is appreciated, however, that first and second feed connections 210 and 212 may alternatively be formed by a variety of other feed lines, which feed lines may be galvanically or capacitively connected to first and second antenna elements 206 and 208, as is well known in the art.

It is appreciated that as a result of first and second antenna elements 206 and 208 being respectively individually fed by first and second feed connections 210 and 212, antenna assembly 200 may be termed a multi-feed antenna assembly. A switch 218 is preferably provided at a junction of first and second feed connections 210 and 212 for switching therebetween.

As best appreciated from consideration of enlargement 216, first and second antenna elements 206 and 208 each have a projection on the plane defined by ground element 202. It is understood that the projection of first and second antenna elements 206 and 208 on the plane defined by ground element 202 includes the orthogonal transformation of all points along first and second antenna elements 206 and 208 onto the plane defined by ground element 202.

It is a particular feature of a preferred embodiment of the present invention that the projection of second antenna element 208 on the plane defined by ground element 202 is at least partially encompassed by the projection of first antenna element 206 on the plane defined by ground element 202. Here, by way of example, a projection of first antenna element 206 preferably encompasses a projection of a portion 222 of second antenna element 208. The encompassment of a portion of a projection of second antenna element 208 by a projection of first antenna element 206, wherein the projections of first and second antenna elements 206 and 208 lie on a common plane, is a particularly advantageous feature of the present invention and is in contrast to conventional multi-feed antenna assemblies, in which multiple antenna elements fed by individual respective feed connections are typically mutually spatially offset so as to avoid an overlap of the respective projections thereof.

As a result of the encompassment of a portion of a projection of second antenna element 208 by a projection of first antenna element 206, wherein the projections of first and second antenna elements 206 and 208 lie on a common plane, multi-feed antenna assembly 200 is extremely compact and occupies only a minimal volume within a wireless device in which antenna assembly 200 may be incorporated.

In operation of antenna assembly 200, switch 218 may be configured so as to allow an RF signal to be delivered to first antenna element 206 by way of first feed connection 210, or to second antenna element 208 by way of second feed connection 212. Antenna assembly 200 thus preferably has two modes of operation, in which modes first antenna element 206 and second antenna element 208 alternatively comprise the fed antenna element.

When switch 218 is configured so as to allow an RF signal to be delivered from RF connector 214 to first antenna element 206 by way of first feed connection 210, first antenna element 206 preferably acts as a coupling element, preferably coupling radiation to second antenna element 208, which second antenna element 208 preferably acts as a ground element with respect to first antenna element 206. First antenna element 206 is thus preferably coupled to ground element 202 by way of second antenna element 208. In this mode of operation of antenna assembly 200, both first and second antenna elements 206 and 208 constitute active radiating elements, preferably radiating in a first frequency band.

When switch 218 is configured so as to allow an RF signal to be delivered from RF connector 214 to second antenna element 208 by way of second feed connection 212, second antenna element 208 preferably acts as a radiating element resonating in a second frequency band. Second antenna element 208 is preferably coupled to ground element 202 by way of a grounding stub 230, preferably located offset from and generally parallel to a feeding stub 232, to which feeding stub 232 feed connection 212 is preferably connected, as seen most clearly in FIG. 2D. It will be readily understood by one skilled in the art that second antenna element 208 thus constitutes a PIFA antenna element. In this mode of operation of antenna assembly 200, first antenna element 206 is inactive and does not participate as a radiating element.

It is appreciated that antenna assembly 200 thus may generally resemble antenna assembly 100 in relevant respects, with the exception of in the relative arrangement of the PIFA antenna element and the coupling antenna element. Whereas in antenna assembly 100, first PIFA antenna element 106 has a projection on the plane of ground element 102 partially encompassing a projection of second coupling antenna element 108 on that plane, in antenna assembly 200, first coupling antenna element 206 has a projection on the plane of ground element 202 partially encompassing a projection of second PIFA antenna element 208 on that plane.

The second frequency band of operation of antenna assembly 200, arising due to the operation of second antenna element 208 as a PIFA antenna, is preferably offset in the frequency domain from the first frequency band of operation of antenna assembly 200, arising due to the coupling between first antenna element 206 and second antenna element 208. Antenna assembly 200 thus constitutes a multiband antenna assembly.

It is a particularly advantageous feature of a preferred embodiment of the present invention that antenna assembly 200 may operate as a multiband antenna assembly, despite its individual antenna elements 206 and 208 being contained within a relatively small, overlapping volume. Antenna assembly 200 is thus particularly well-suited for inclusion in a hand-held wireless device, which hand-held wireless device may contain additional functional elements, such as, by way of example only, a speaker 240 and an antenna carrier 242, on which antenna carrier 242 first and second antenna elements 206 and 208 may be disposed.

It is appreciated that the particular illustrated configurations of first antenna element 206 and second antenna element 208 are by way of example only and that the topology and relative placement of first and second antenna elements 206 and 208 may be modified, provided that a projection of second antenna element 208 on the plane defined by ground element 202 remains at least partially encompassed by a projection of first antenna element 206 on that plane.

Reference is now made to FIGS. 3A, 3B, 3C and 3D, which are simplified respective first and second top and posterior and anterior perspective view illustrations of an antenna assembly constructed and operative in accordance with a further preferred embodiment of the present invention.

As seen in FIGS. 3A-3D, there is provided an antenna assembly 300, including a ground element 302 having an edge 304. As seen most clearly in FIG. 3A, ground element 302 preferably lies in a plane defined thereby. In the illustrated embodiment of ground element 302 shown in FIGS. 3A-3D, ground element 302 is shown to be a planar element, the entirety of which element lies in a single plane. It is appreciated, however, that ground element 302 may alternatively comprise non-planar portions, which non-planar portions may extend beyond the plane defined by ground element 302.

A first antenna element 306 and a second antenna element 308 are preferably provided adjacent to edge 304. First antenna element 306 preferably comprises a meandering element and second antenna element 308 preferably comprises a crescent-like element, preferably located adjacent to first antenna element 306. First antenna element 306 is preferably fed by way of a first feed connection 310 and second antenna element 308 is preferably fed by way of a second feed connection 312. First and second feed connections 310 and 312 preferably each terminate at an RF connector 314, wherefrom first and second feed connections 310 and 312 preferably receive an RF signal. In the embodiment of antenna assembly 300 illustrated in FIGS. 3A-3D RF connector 314 is shown to be located upon ground element 302. It is appreciated, however, that RF connector may alternatively be located offset from ground element 302, depending on the design requirements of a wireless device within which antenna assembly 300 is incorporated.

Figure 3A:
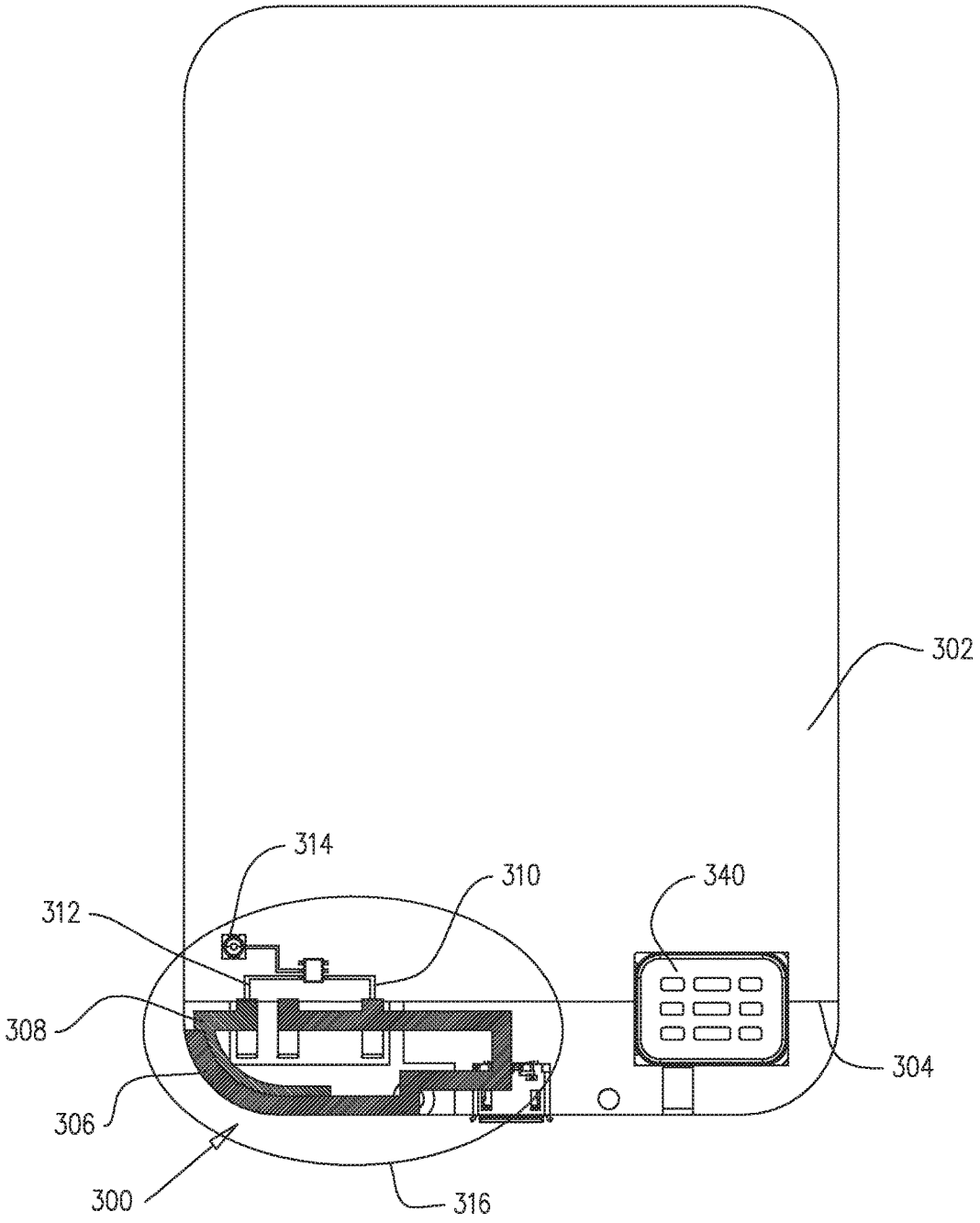
FIGS. 3A, 3B, 3C and 3D are simplified respective first and second top and posterior and anterior perspective view illustrations of an antenna assembly constructed and operative in accordance with a further preferred embodiment of the present invention.
Figure 3B:
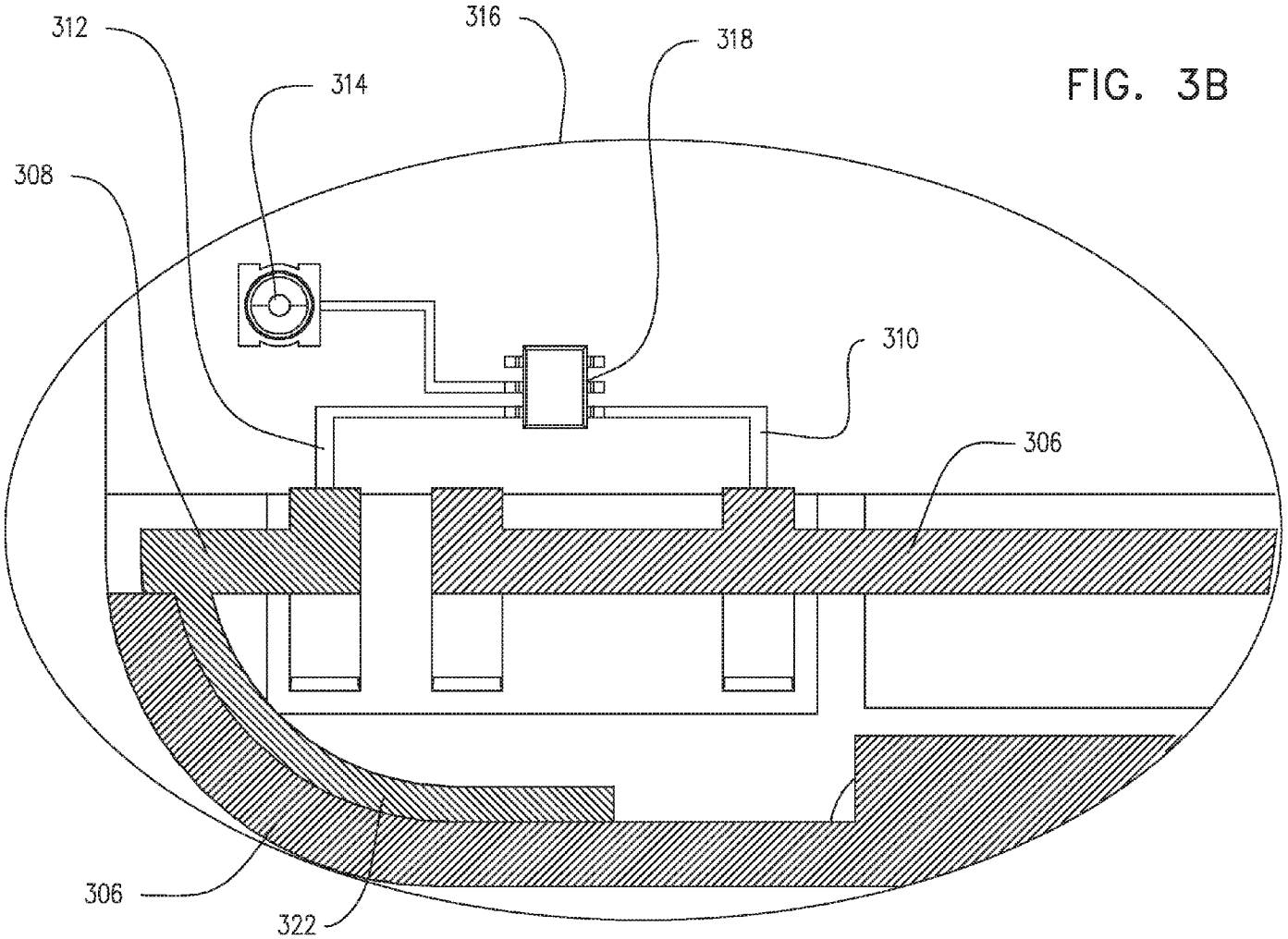
Figure 3C:
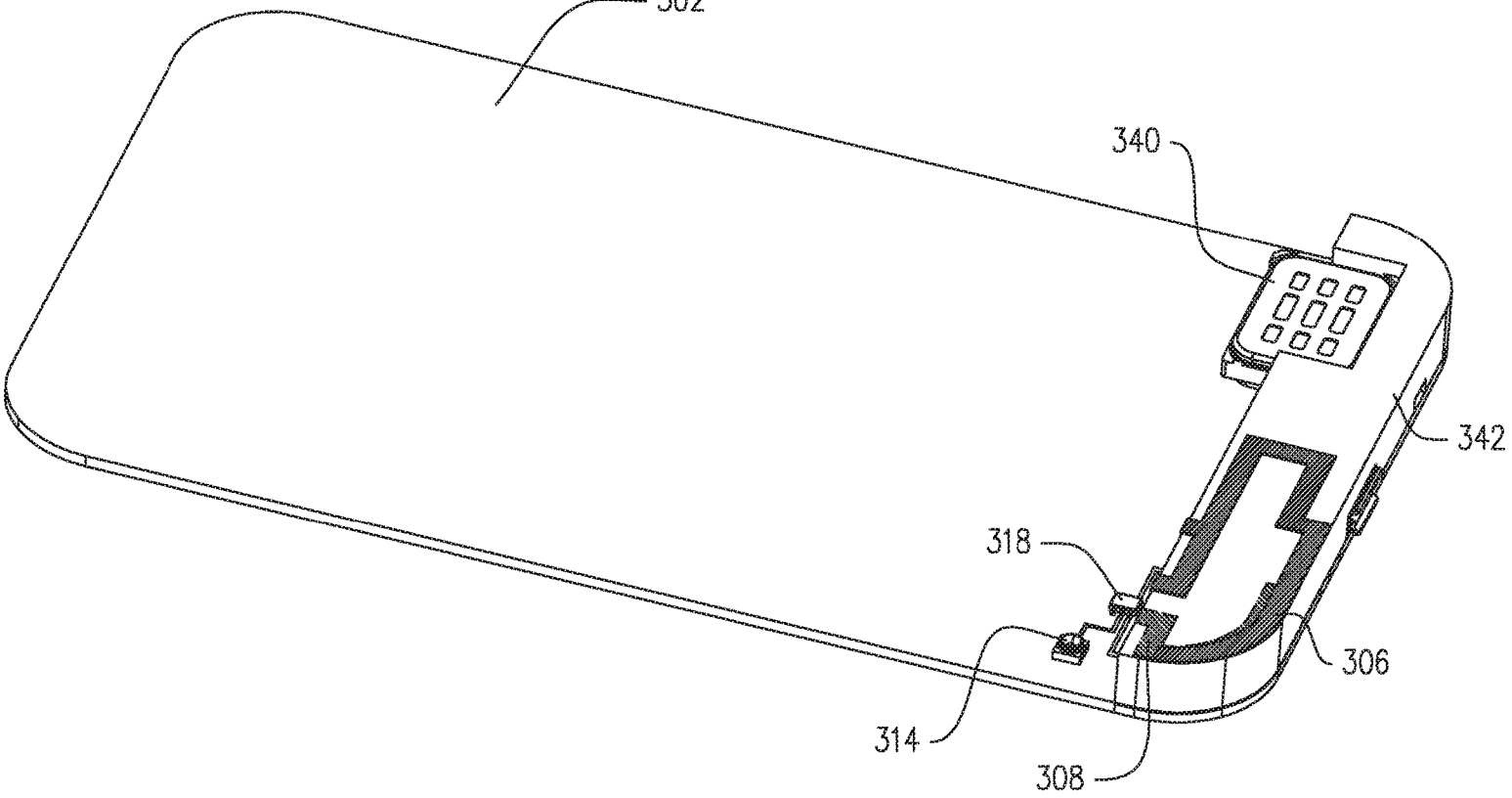
Figure 3D:
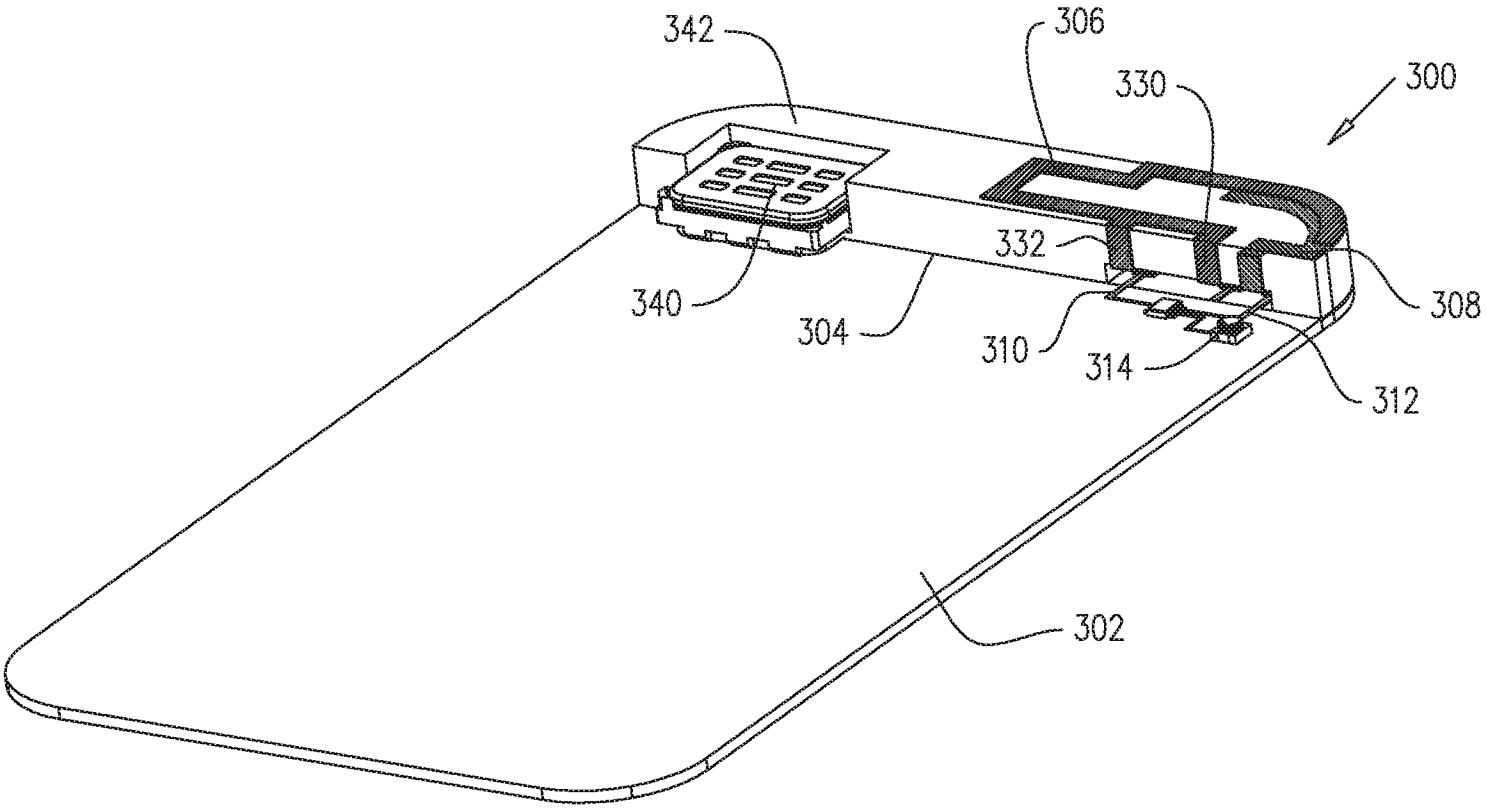

As seen most clearly at an enlargement 316 in FIG. 3B, first and second feed connections 310 and 312 are preferably each formed by conductive striplines respectively galvanically connected to first and second antenna elements 306 and 308. It is appreciated, however, that first and second feed connections 310 and 312 may alternatively be formed by a variety of other feed lines, which feed lines may be galvanically or capacitively connected to first and second antenna elements 306 and 308, as is well known in the art.

It is appreciated that as a result of first and second antenna elements 306 and 308 being respectively individually fed by first and second feed connections 310 and 312, antenna assembly 300 may be termed a multi-feed antenna assembly. A switch 318 is preferably provided at a junction of first and second feed connections 310 and 312 for switching therebetween.

As best appreciated from consideration of enlargement 316, first and second antenna elements 306 and 308 each have a projection on the plane defined by ground element 302. It is understood that the projection of first and second antenna elements 306 and 308 on the plane defined by ground element 302 includes the orthogonal transformation of all points along first and second antenna elements 306 and 308 onto the plane defined by ground element 302.

It is a particular feature of a preferred embodiment of the present invention that the projection of second antenna element 308 on the plane defined by ground element 302 is at least partially encompassed by the projection of first antenna element 306 on the plane defined by ground element 302. Here, by way of example, a projection of first antenna element 306 preferably encompasses a projection of a portion 322 of second antenna element 308.

As a result of the encompassment of a portion of a projection of second antenna element 308 by a projection of first antenna element 306, wherein the projections of first and second antenna elements 306 and 308 lie on a common plane, multi-feed antenna assembly 300 is extremely compact and occupies only a minimal volume within a wireless device in which antenna assembly 300 may be incorporated. This is in contrast to conventional multi-feed antenna assemblies, in which multiple antenna elements fed by individual respective feed connections are typically mutually spatially offset so as to avoid an overlap of the respective projections thereof and prevent undesirable coupling therebetween.

In operation of antenna assembly 300, switch 318 may be configured to allow an RF signal to be delivered to first antenna element 306 by way of first feed connection 310, or to second antenna element 308 by way of second feed connection 312. Antenna assembly 300 thus preferably has two modes of operation, in which modes of operation first antenna element 306 and second antenna element 308 alternatively comprise the fed antenna element.

When switch 318 is configured so as to allow an RF signal to be delivered from RF connector 314 to first antenna element 306 by way of first feed connection 310, first antenna element 306 preferably acts as a radiating element preferably resonating in a first frequency band. First antenna element 306 is preferably coupled to ground element 302 by way of a grounding stub 330, preferably located offset from and generally parallel to a feeding stub 332, to which feeding stub 332 feed connection 310 is preferably connected, as seen most clearly in FIG. 3D. It will be readily understood by one skilled in the art that antenna element 306 thus constitutes a PIFA antenna element. In this mode of operation of antenna assembly 300, second antenna element 308 is inactive and does not participate as a radiating element.

When switch 318 is configured so as to allow an RF signal to be delivered from RF connector 314 to second antenna element 308 by way of second feed connection 312, second antenna element 308 preferably acts as a coupling element, preferably coupling radiation to first antenna element 306, which first antenna element 306 preferably acts as a ground element with respect to second antenna element 308. Second antenna element 308 is thus preferably coupled to ground element 302 by way of first antenna element 306. In this mode of operation of antenna assembly 300, both first and second antenna elements 306 and 308 constitute active radiating elements, preferably radiating in a second frequency band.

The second frequency band of operation of antenna assembly 300, arising due to the coupling between second antenna element 308 and first antenna element 306, is preferably offset in the frequency domain from the first frequency band of operation of antenna assembly 300, arising due to the operation of first antenna element 306 as a PIFA antenna. Antenna assembly 300 thus constitutes a multiband antenna assembly.

It is a particularly advantageous feature of a preferred embodiment of the present invention that antenna assembly 300 may operate as a multiband antenna assembly, despite its individual antenna elements 306 and 308 being contained within a relatively small, overlapping volume. Antenna assembly 300 is thus particularly well-suited for inclusion in a hand-held wireless device, which hand-held wireless device may contain additional functional elements, such as, by way of example only, a speaker 340.

It is a particular feature of a preferred embodiment of the present invention that first and second antenna elements 306 and 308 are preferably located at different heights above the plane defined by ground element 302. As seen most clearly in FIGS. 3C and 3D, first antenna element 306 may be located on an upper surface of a non-conductive antenna carrier 342 and second antenna element 308 may be housed within non-conductive antenna carrier 342. It is appreciated that non-conductive antenna carrier 342 is shown as transparent in FIGS. 3A and 3B for the purposes of clarity of presentation only, in order to more clearly depict the relative locations of the projections of first and second antenna elements 306 and 308 on the plane defined by ground element 302. The voltage standing wave ratio (VSWR) and resonant frequencies of antenna assembly 300 may be modified by way of adjustment of the spatial separation between first and second antenna elements 306 and 308.

It is further appreciated that the particular illustrated configurations of first antenna element 306 and second antenna element 308 are exemplary only and that the topology and relative placement of first and second antenna elements 306 and 308 may be modified, provided that a projection of second antenna element 308 on the plane defined by ground element 302 remains at least partially encompassed by a projection of first antenna element 306 on that plane.

Reference is now made to FIGS. 4A, 4B, 4C and 4D, which are simplified respective first and second top and posterior and anterior perspective view illustrations of an antenna assembly constructed and operative in accordance with yet another preferred embodiment of the present invention.

As seen in FIGS. 4A-4D, there is provided an antenna assembly 400, including a ground element 402 having an edge 404. As seen most clearly in FIG. 4A, ground element 402 preferably lies in a plane defined thereby. In the illustrated embodiment of ground element 402 shown in FIGS. 4A-4D, ground element 402 is shown to be a planar element, the entirety of which element lies in a single plane. It is appreciated, however, that ground element 402 may alternatively comprise non-planar portions, which non-planar portions may extend beyond the plane defined by ground element 402.

A first antenna element 406 and a second antenna element 408 are preferably provided adjacent to edge 404 and coupled thereto. As seen most clearly in FIGS. 4C and 4D, first antenna element 406 preferably comprises a labyrinthine element and second antenna element 408 preferably comprises first antenna element 406 in addition to an open-ended stub portion 409 extending therefrom.

First antenna element 406 is preferably fed by way of a first feed connection 410, preferably connected thereto at a connection point 411. Second antenna element 408 is preferably fed by way of a second feed connection 412, preferably connected thereto at open-ended stub 409. First and second feed connections 410 and 412 preferably each terminate at an RF connector 414, wherefrom first and second feed connections 410 and 412 preferably receive an RF signal. In the embodiment of antenna assembly 400 illustrated in FIGS. 4A-4D RF connector 414 is shown to be located upon ground element 402. It is appreciated, however, that RF connector may alternatively be located offset from ground element 402, depending on the design requirements of a wireless device within which antenna assembly 400 is incorporated.

Figure 4A:
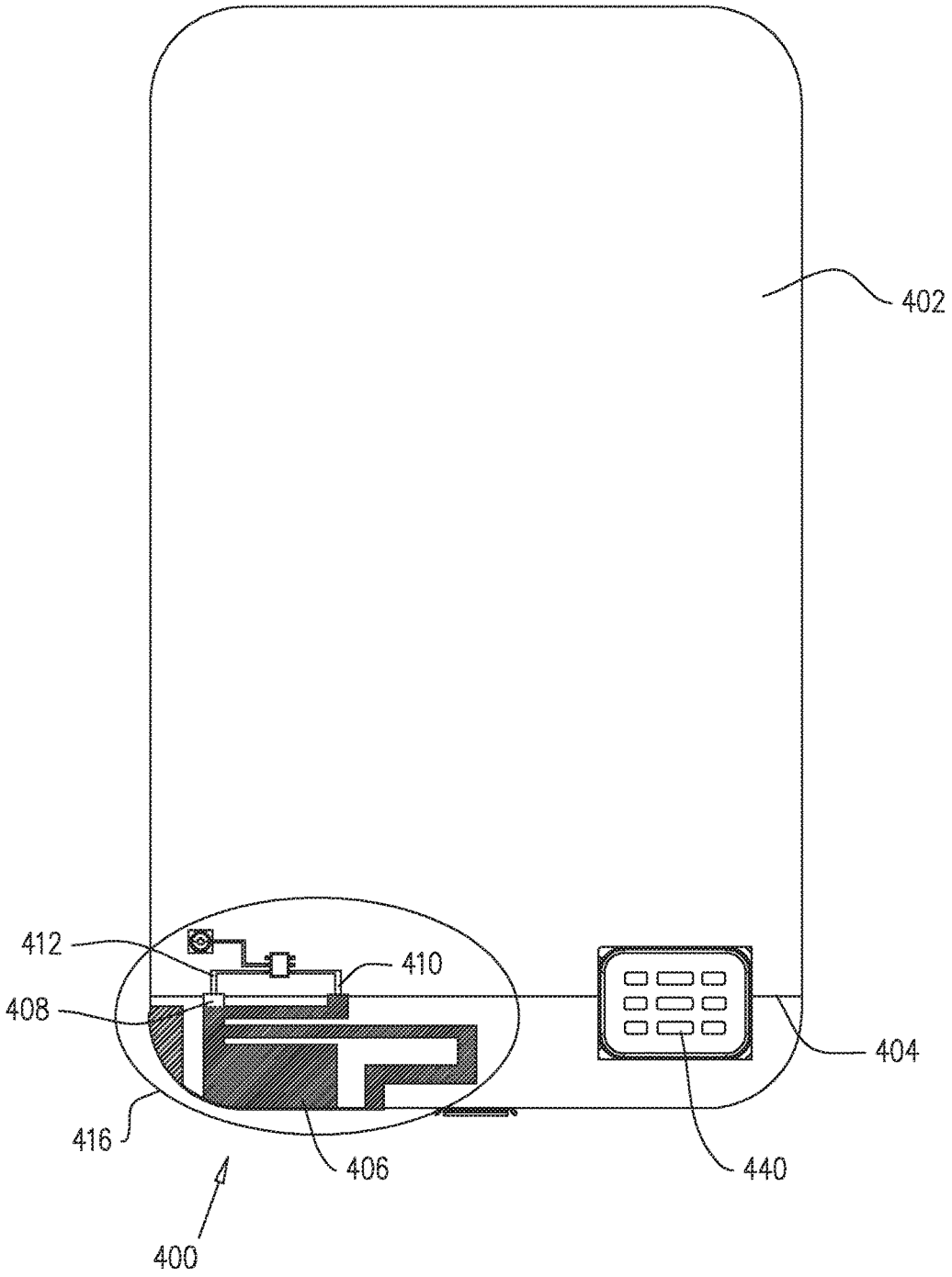
FIGS. 4A, 4B, 4C and 4D are simplified respective first and second top and posterior and anterior perspective view illustrations of an antenna assembly constructed and operative in accordance with yet another preferred embodiment of the present invention.
Figure 4B:
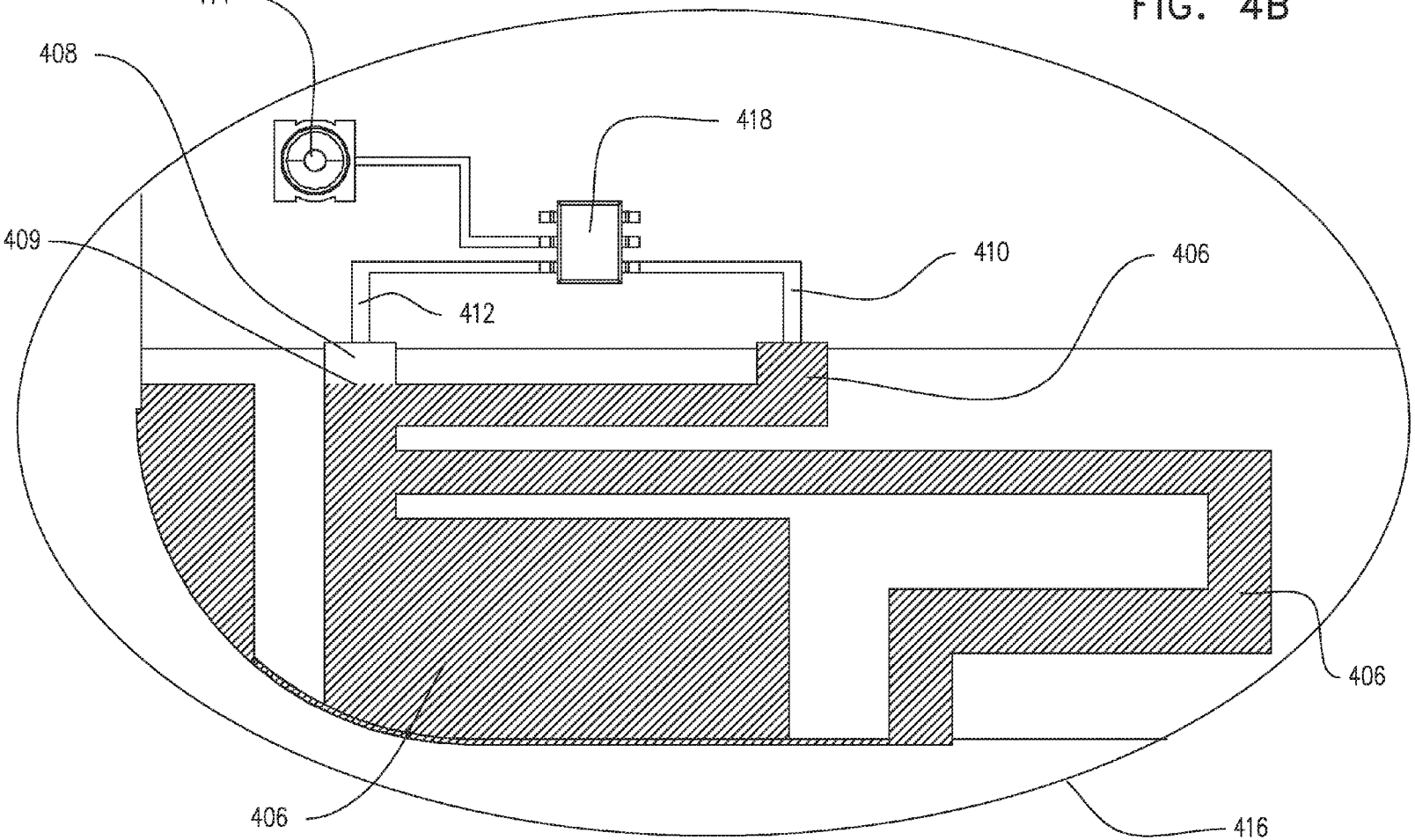
Figure 4C:
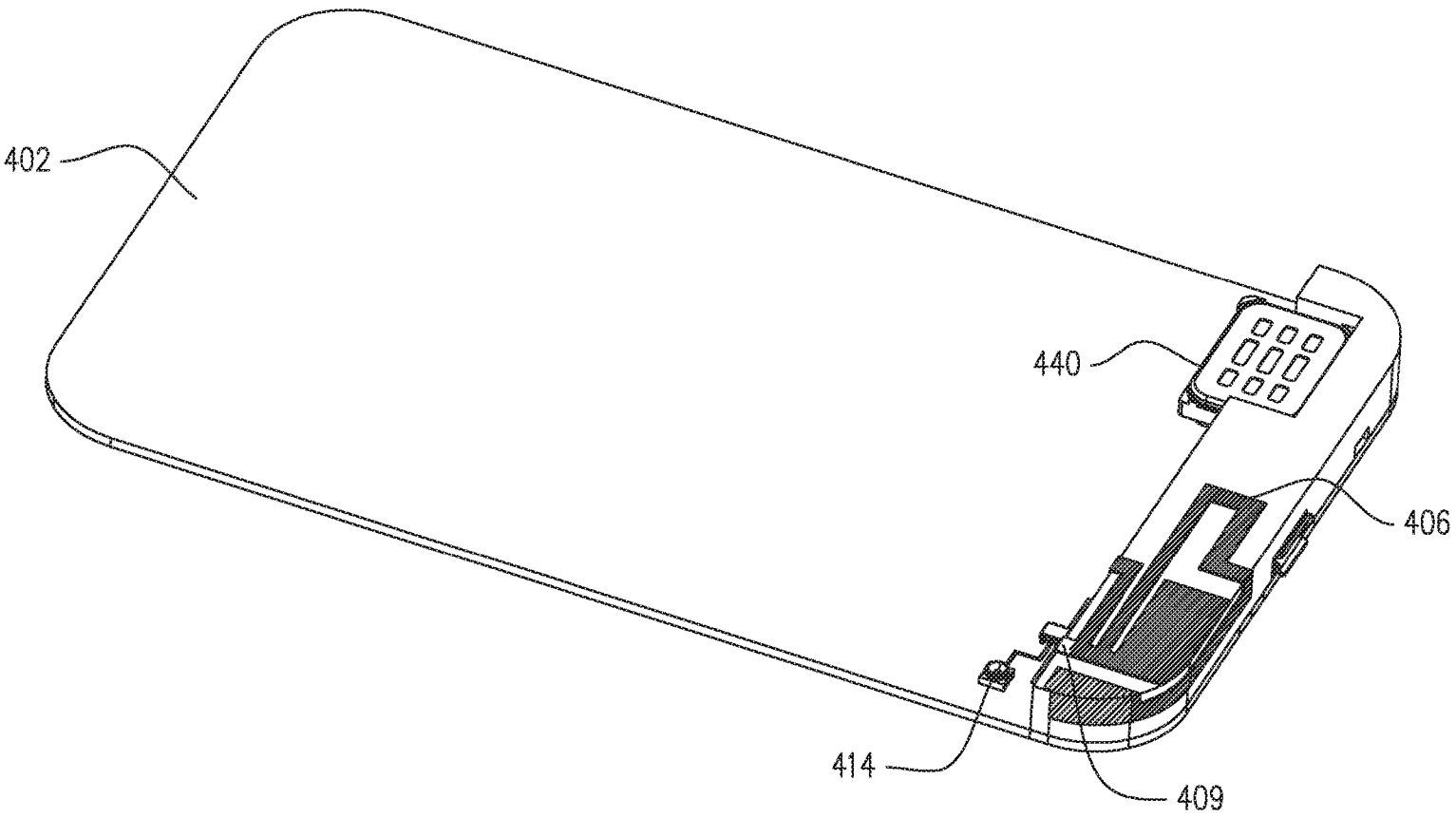
Figure 4D:
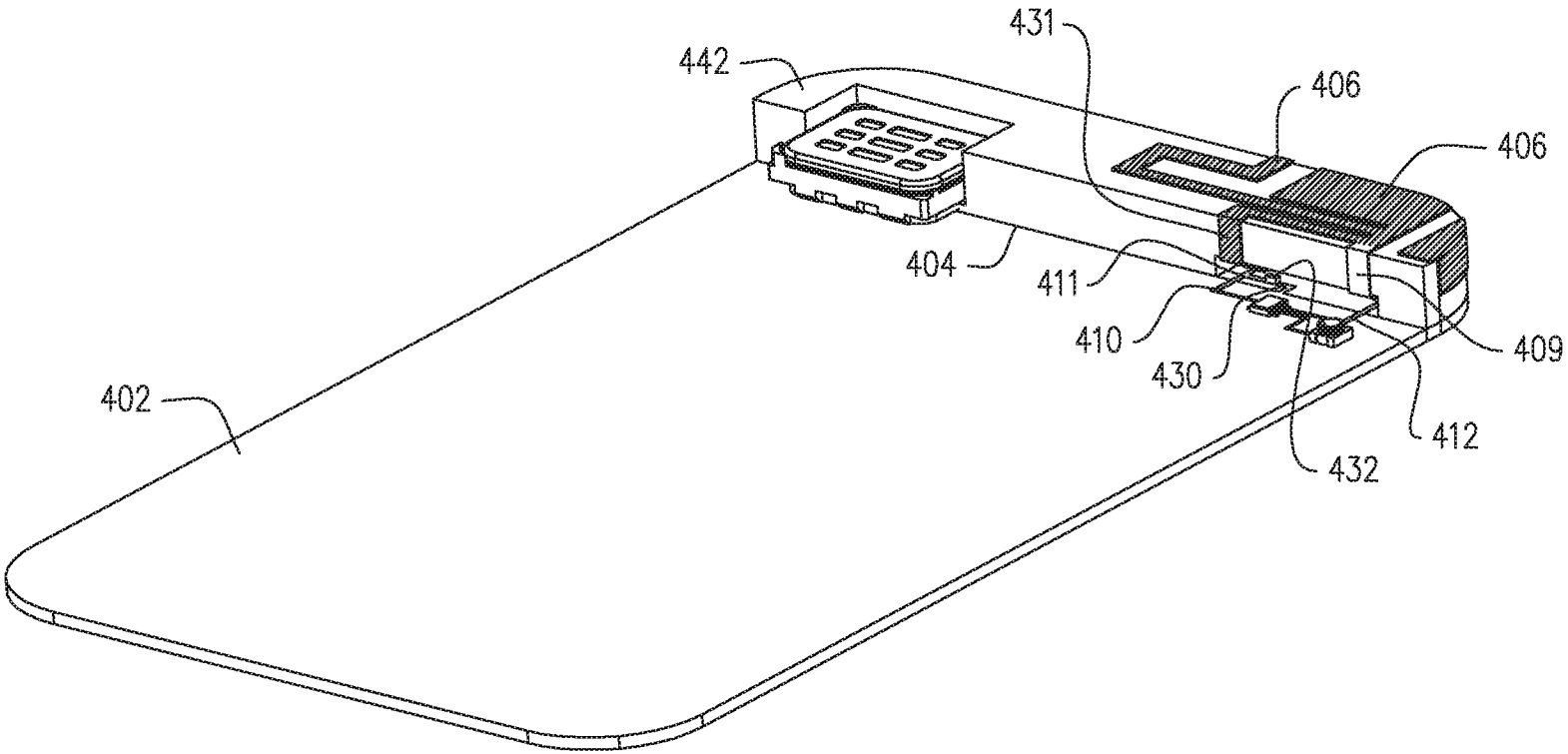

As seen most clearly at an enlargement 416 in FIG. 4B, first and second feed connections 410 and 412 are preferably each formed by conductive striplines respectively galvanically connected to first and second antenna elements 406 and 408. It is appreciated, however, that first and second feed connections 410 and 412 may alternatively be formed by a variety of other feed lines, which feed lines may be galvanically or capacitively connected to first and second antenna elements 406 and 408, as is well known in the art.

It is appreciated that as a result of first and second antenna elements 406 and 408 being respectively individually fed by first and second feed connections 410 and 412, antenna assembly 400 may be termed a multi-feed antenna assembly. A switch 418 is preferably provided at a junction of first and second feed connections 410 and 412 for switching therebetween.

As best appreciated from consideration of enlargement 416, first and second antenna elements 406 and 408 each have a projection on the plane defined by ground element 402. It is understood that the projection of first and second antenna elements 406 and 408 on the plane defined by ground element 402 includes the orthogonal transformation of all points along first and second antenna elements 406 and 408 onto the plane defined by ground element 402.

It is a particular feature of a preferred embodiment of the present invention that the projection of second antenna element 408 on the plane defined by ground element 402 is at least partially encompassed by the projection of first antenna element 406 on the plane defined by ground element 402. Here, by way of example, a projection of first antenna element 406 preferably overlaps with a projection of second antenna element 408 and encompasses a projection of open-ended stub portion 409 of second antenna element 408.

As a result of the encompassment of a portion of a projection of second antenna element 408 by a projection of first antenna element 406, wherein the projections of first and second antenna elements 406 and 408 lie on a common plane, multi-feed antenna assembly 400 is extremely compact and occupies only a minimal volume within a wireless device in which antenna assembly 400 may be incorporated. This is in contrast to conventional multi-feed antenna assemblies, in which multiple antenna elements fed by individual respective feed connections are typically mutually spatially offset, so as to avoid an overlap of the respective projections thereof and prevent undesirable coupling therebetween.

In operation of antenna assembly 400, switch 418 may be configured so as to allow an RF signal to be delivered to first antenna element 406 by way of first feed connection 410, or may be configured so as to allow an RF signal to be delivered to second antenna element 408 by way of second feed connection 412. Antenna assembly 400 thus has two modes of operation, in which modes of operation first antenna element 406 and second antenna element 408 alternatively comprise the fed antenna element.

When switch 418 is configured so as to allow an RF signal to be delivered from RF connector 414 to first antenna element 406 by way of first feed connection 410, first antenna element 406 preferably acts as a monopole radiating element, preferably resonating in a first frequency band. Antenna element 406 is preferably coupled to ground element 402 by way of a ground connection 430 preferably connected to a ground stub 431, as seen most clearly in FIG. 4D. Ground connection 430 is preferably formed by conductive traces extending between antenna element 406 and edge 404 of ground element 402. Ground connection 430 may optionally include an inductive component 432, although it is appreciated that such a component may be obviated, depending on the operating requirements of first antenna element 406. In this mode of operation of antenna assembly 400, open-ended stub portion 409 is inactive.

When switch 418 is configured so as to allow an RF signal to be delivered from RF connector 414 to second antenna element 408 by way of second feed connection 412, second antenna element 408 preferably acts as a PIFA antenna element, including a ground connection provided by ground stub 431 and a feed connection provided by open-ended stub portion 409. Second antenna element 408 is thus preferably galvanically coupled to ground element 402 by way of ground connection 430. In this mode of operation of antenna assembly 400, the entirety of second antenna element 408, including first antenna element 406 and open-ended stub 409, preferably acts as a radiating element, preferably radiating in a second frequency band.

The second frequency band of operation of antenna assembly 400, arising due to the operation of second antenna element 408 as a PIFA antenna, is preferably offset in the frequency domain from the first frequency band of operation of antenna assembly 400, arising due to the operation of first antenna element 406 as a monopole antenna. Antenna assembly 400 thus constitutes a multiband antenna assembly.

It is a particularly advantageous feature of a preferred embodiment of the present invention that antenna assembly 400 may operate as a multiband antenna assembly, despite its individual antenna elements 406 and 408 being contained within a relatively small, overlapping volume. Antenna assembly 400 is thus particularly well-suited for inclusion in a compact hand-held wireless device, which hand-held wireless device may contain additional functional elements, such as, by way of example only, a speaker 440 and a non-conductive antenna carrier 442, which non-conductive antenna carrier 442 may serve to support first and second antenna elements 406 and 408.

It is appreciated that the particular illustrated configurations of first antenna element 406 and second antenna element 408 are exemplary only and that the topology and relative placement of first and second antenna elements 406 and 408 may be modified, provided that a projection of second antenna element 408 on the plane defined by ground element 402 remains at least partially encompassed by a projection of first antenna element 406 on that plane.

Reference is now made to FIGS. 5A, 5B, 5C and 5D, which are simplified respective first and second top and first and second perspective view illustrations of an antenna assembly constructed and operative in accordance with yet a further preferred embodiment of the present invention.

As seen in FIGS. 5A-5D, there is provided an antenna assembly 500, preferably incorporated into a wireless device 501. Antenna assembly 500 preferably includes a ground element 502 having an edge 504. As seen most clearly in FIG. 5A, ground element 502 preferably lies in a plane defined thereby. In the illustrated embodiment of ground element 502 shown in FIGS. 5A-5D, ground element 502 is shown to be a planar element, the entirety of which element lies in a single plane. It is appreciated, however, that ground element 502 may alternatively comprise non-planar portions, which non-planar portions may extend beyond the plane defined by ground element 502.

A first antenna element 506 and a second antenna element 508 are preferably provided adjacent to edge 504 and coupled thereto. As seen most clearly in FIGS. 5C and 5D, first antenna element 506 preferably comprises a loop element and second antenna element 508 preferably comprises a meandering element preferably disposed within the volume circumscribed by first antenna element 506.

First antenna element 506 is preferably fed by way of a first feed connection 510 and second antenna element 508 is preferably fed by way of a second feed connection 512. First and second feed connections 510 and 512 preferably each receive an RF signal at an RF connector (not shown). It is appreciated that as a result of first and second antenna elements 506 and 508 being respectively individually fed by first and second feed connections 510 and 512, antenna assembly 500 may be termed a multi-feed antenna assembly.

Figure 5A:
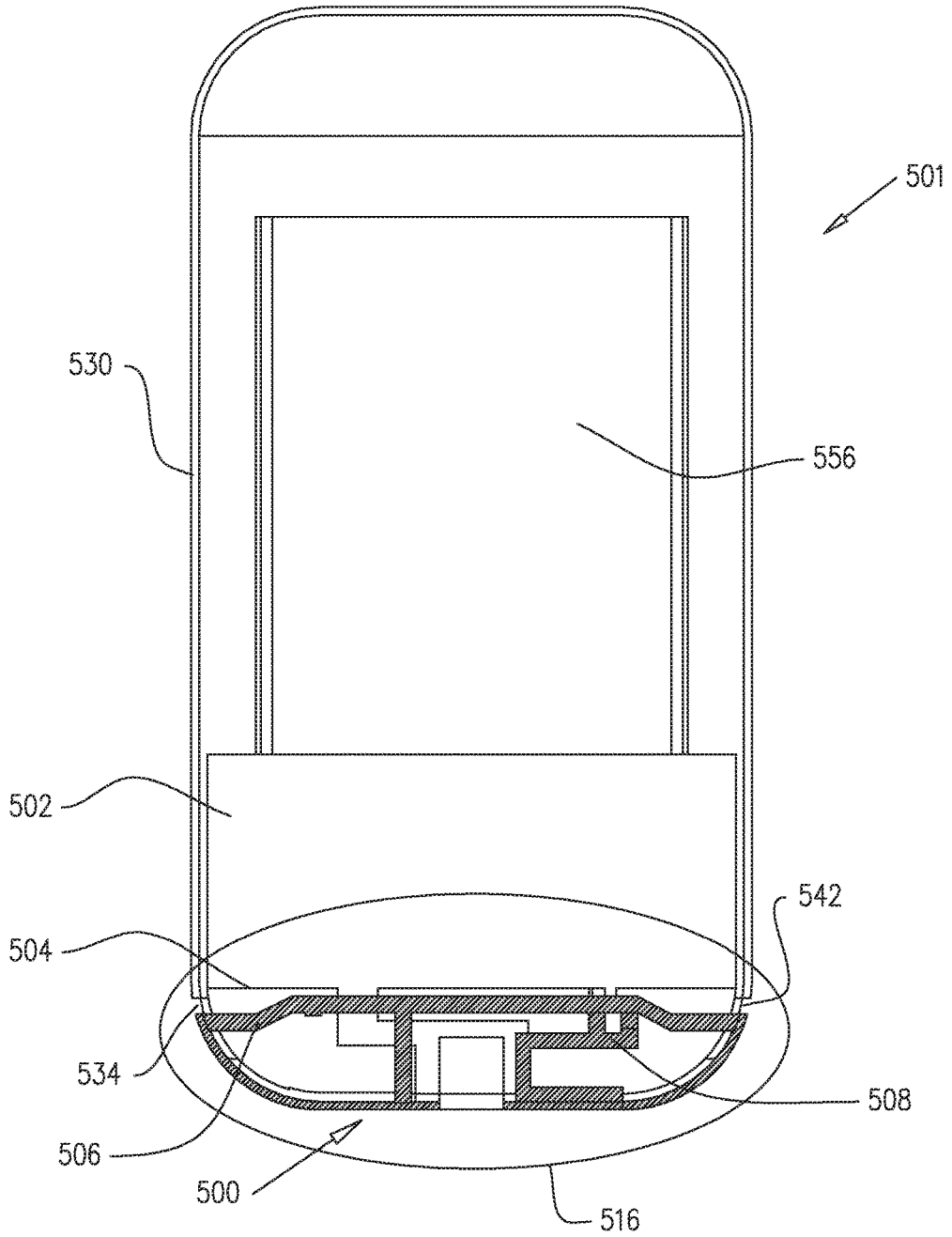
FIGS. 5A, 5B, 5C and 5D are simplified respective first and second top and first and second perspective view illustrations of an antenna assembly constructed and operative in accordance with yet a further preferred embodiment of the present invention.
Figure 5B:
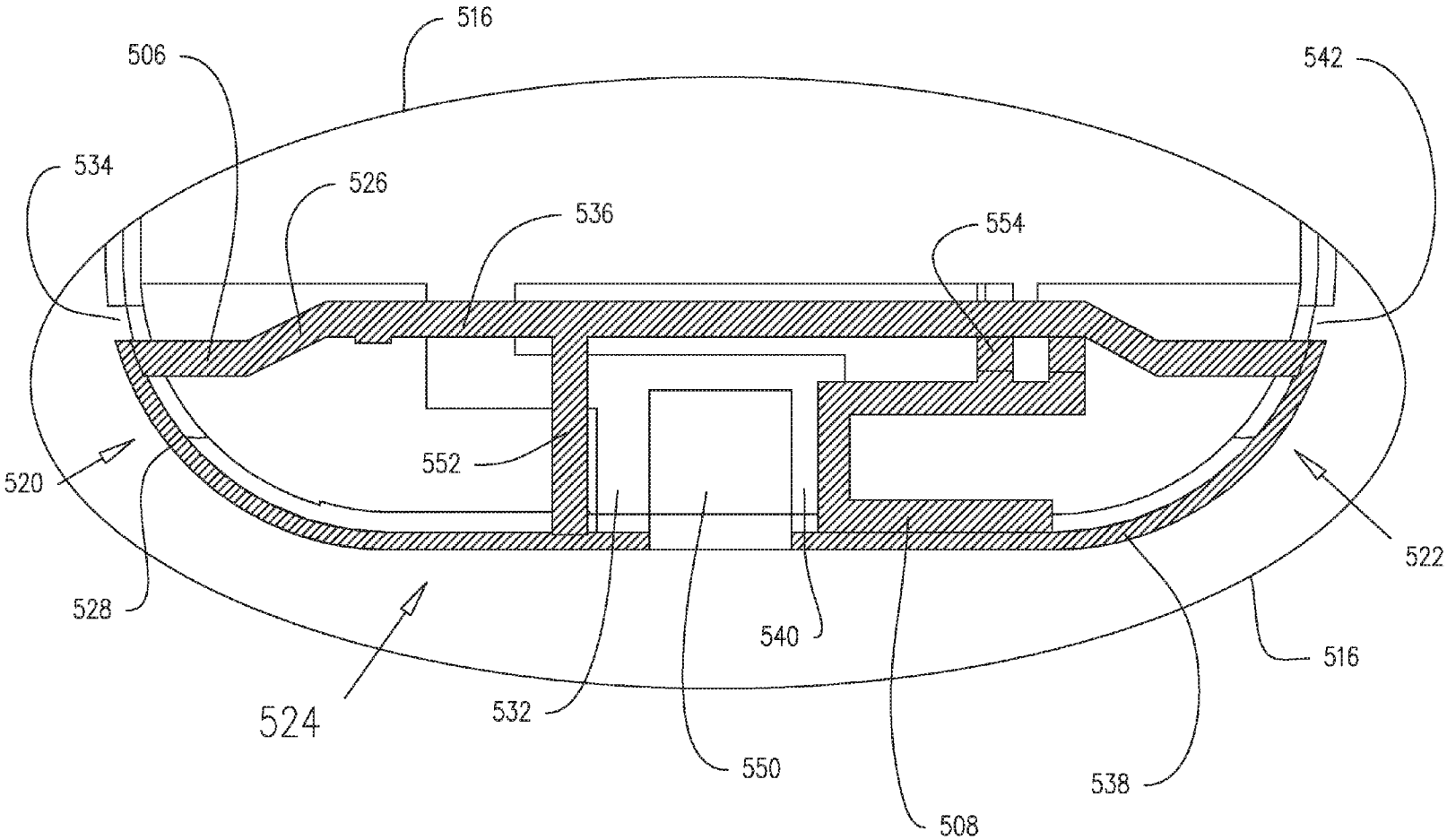
Figure 5C:
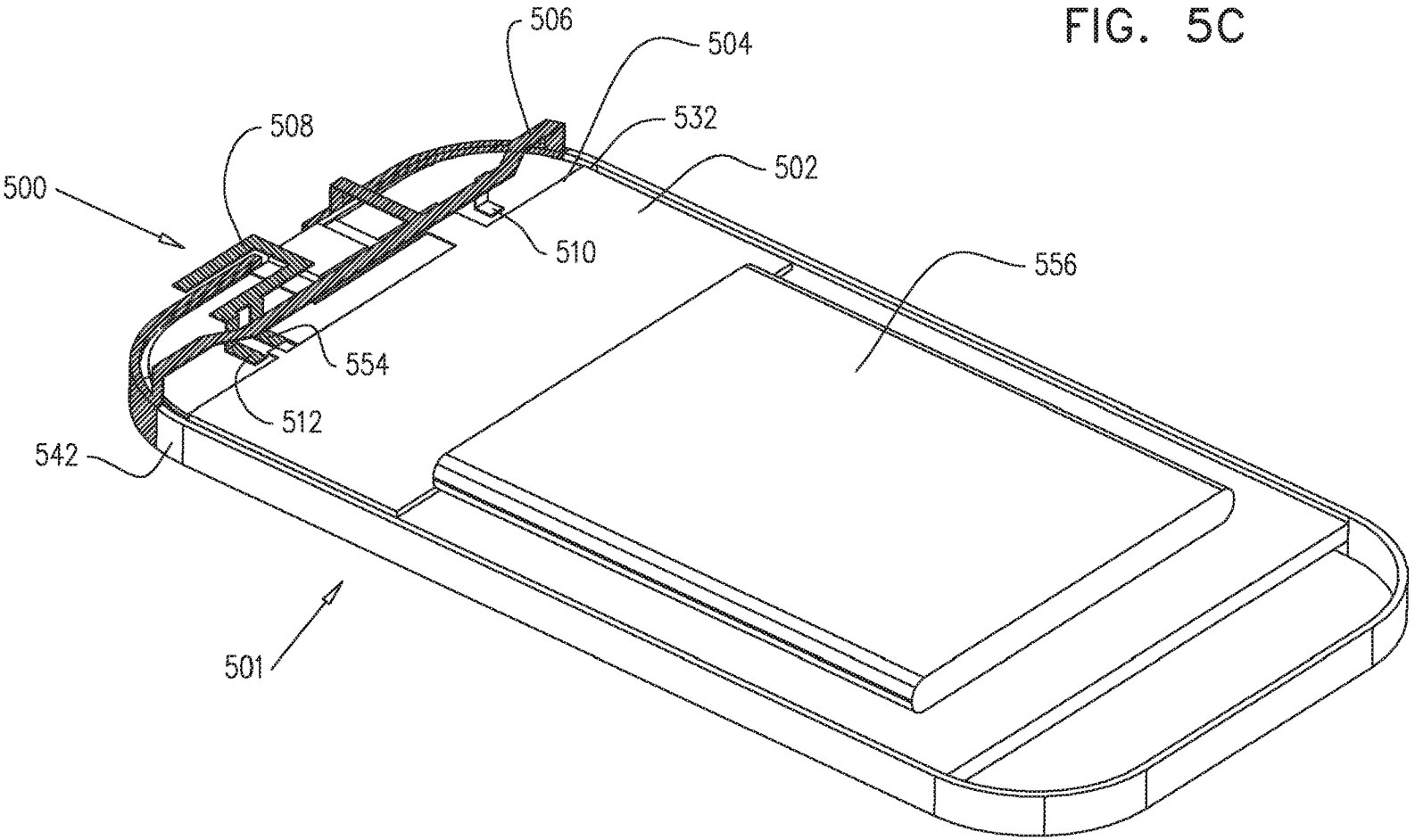
Figure 5D:
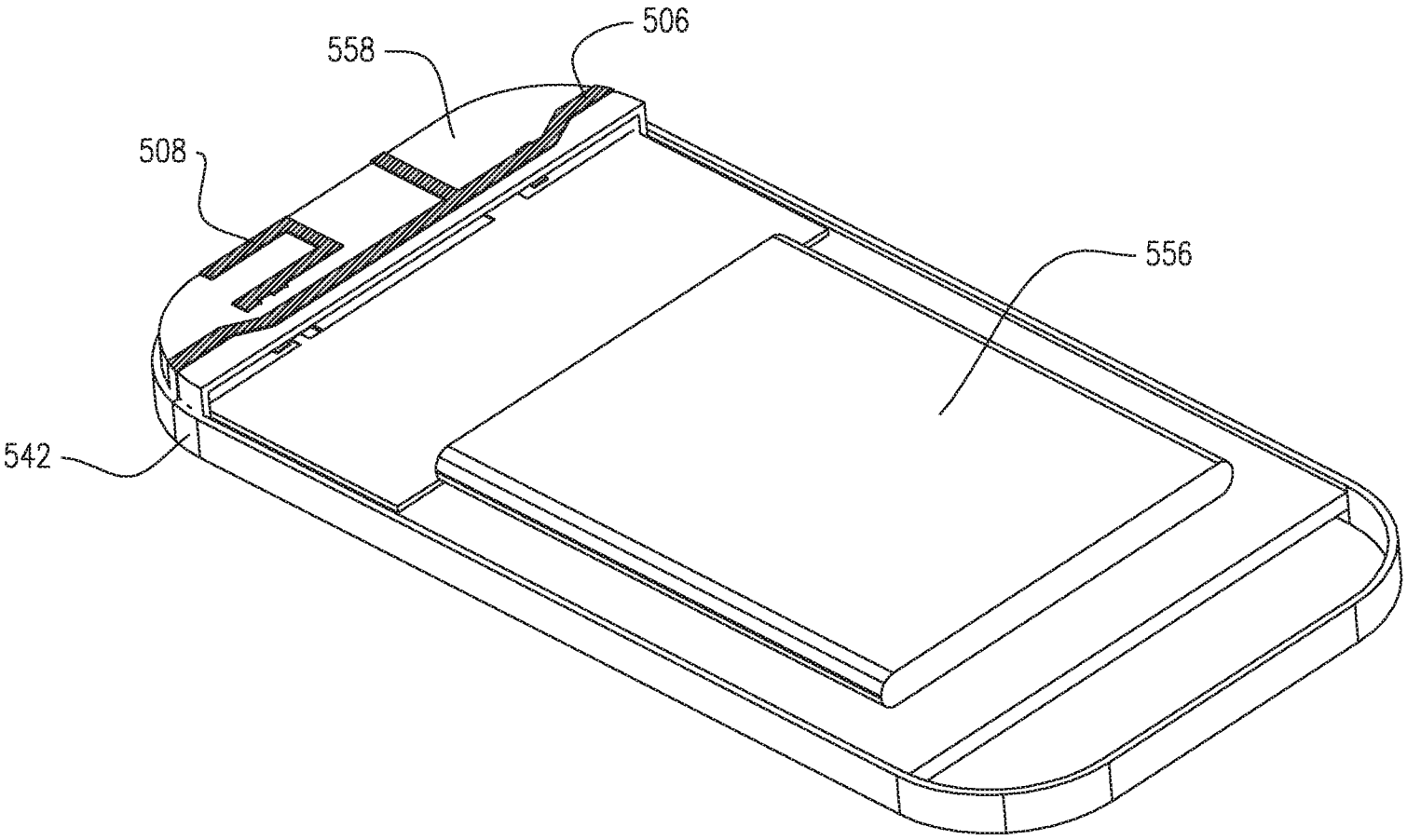

As best appreciated from consideration of an enlargement 516 in FIG. 5B, first and second antenna elements 506 and 508 each have a projection on the plane defined by ground element 502. It is understood that the projection of first and second antenna elements 506 and 508 on the plane defined by ground element 502 includes the orthogonal transformation of all points along first and second antenna elements 506 and 508 onto the plane defined by ground element 502.

It is a particular feature of a preferred embodiment of the present invention that the projection of second antenna element 508 on the plane defined by ground element 502 is at least partially encompassed by the projection of first antenna element 506 on the plane defined by ground element 502. Here, by way of example, a projection of first antenna element 506 preferably entirely encloses a projection of second antenna element 508.

As a result of the encompassment of at least a portion of a projection of second antenna element 508 by a projection of first antenna element 506, wherein the projections of first and second antenna elements 506 and 508 lie on a common plane, multi-feed antenna assembly 500 is extremely compact and occupies only a minimal volume within wireless device 501. This is in contrast to conventional multi-feed antenna assemblies, in which multiple antenna elements fed by individual respective feed connections are typically mutually spatially offset, so as to avoid an overlap of the respective projections thereof and prevent undesirable coupling therebetween.

In operation of antenna assembly 500, first and second feed connections 510 and 512 may respectively simultaneously feed first and second antenna elements 506 and 508. First antenna element 506 preferably operates as a triple loop radiating element, preferably including a first loop radiating element 520, a second loop radiating element 522 and a third loop radiating element 524.

As seen most clearly in FIG. 5B, first loop radiating element 520 preferably comprises a first portion 526 extending adjacent to feed connection 510, a second portion 528 preferably formed by a section of a conductive frame 530 of wireless device 501 and a third portion 532 preferably formed by a section of ground element 502. Second portion 528 is preferably bound at one end thereof by a first gap 534 preferably formed in conductive frame 530.

Second loop radiating element 522 preferably comprises a first segment 536 preferably extending adjacent to feed connection 510, a second segment 538 preferably formed by a section of conductive frame 530 and a third segment 540 preferably formed by a section of ground element 502. Second segment 538 is preferably bound at one end thereof by a second gap 542 preferably formed in conductive frame 530.

Third loop radiating element 524 preferably comprises first portion 526 and first segment 536, in conjunction with second portion 528 and second segment 538 of conductive frame 530. The conductive loop path of third loop radiating element 524 is preferably completed by way of a charging connector 550, which charging connector 550 preferably bridges second portion 528 and second segment 538. It is understood, however, that the inclusion of charging connector 550 in antenna assembly 500 is optional and that charging connector 550 may be alternatively be obviated and second portion 528 and second segment 538 bridged by alternative conductive elements.

It is appreciated that first antenna element 506 thus constitutes a triple loop antenna, preferably including first loop 520, second loop 522 and third loop 524. It is understood that the extent of first antenna element 506 indicated by a hatched portion in FIGS. 5A-5D excludes those portions of first antenna element 506 formed by ground element 502, as described above. First antenna element 506 preferably operates in at least one low frequency band, preferably centered at approximately 900 Mhz, and at least one high frequency band, preferably centered at approximately 1990 MHz. The VSWR of first antenna element 506 is preferably improved as a result of the presence of a gamma matching element 552, preferably bridging portions of first loop radiating element 520.

In the embodiment of first antenna element 506 illustrated in FIGS. 5A-5D, first loop radiating element 520, second loop radiating element 522 and third loop radiating element 524 are each preferably partially formed by a portion of conductive frame 530. It is appreciated, however, that each one of loop radiating elements 520, 522 and 524 may alternatively be entirely formed by conductive structures other than a conductive frame of a wireless device, which conductive structures may be free-standing or may be disposed on a supporting substrate.

Second antenna element 508 preferably operates in a GPS or WLAN frequency band, which frequency band is preferably sufficiently offset from the frequency of operation of first antenna element 506 so as to minimize interference therebetween. Second antenna element 508 is preferably galvanically coupled to ground element 502 at a ground connection point 554, although it is appreciated that the particular configuration of ground connection 554 is exemplary only and may be modified according to the design requirements of second antenna element 508.

It is a particularly advantageous feature of a preferred embodiment of the present invention that antenna assembly 500 may operate as a multiband antenna assembly, despite its individual antenna elements 506 and 508 being contained within a relatively small, common volume. Antenna assembly 500 is thus particularly well-suited for inclusion in wireless device 501, which wireless device may contain additional functional elements, such as, by way of example only, a battery cover 556. First and second antenna elements may optionally be held in place by a non-conductive antenna carrier 558, illustrated in FIG. 5D.

It is appreciated that the particular illustrated configurations of first antenna element 506 and second antenna element 508 are exemplary only and that the topology and relative placement of first and second antenna elements 506 and 508 may be modified, provided that a projection of second antenna element 508 on the plane defined by ground element 502 remains at least partially encompassed by a projection of first antenna element 506 on that plane.

Figure 6A:
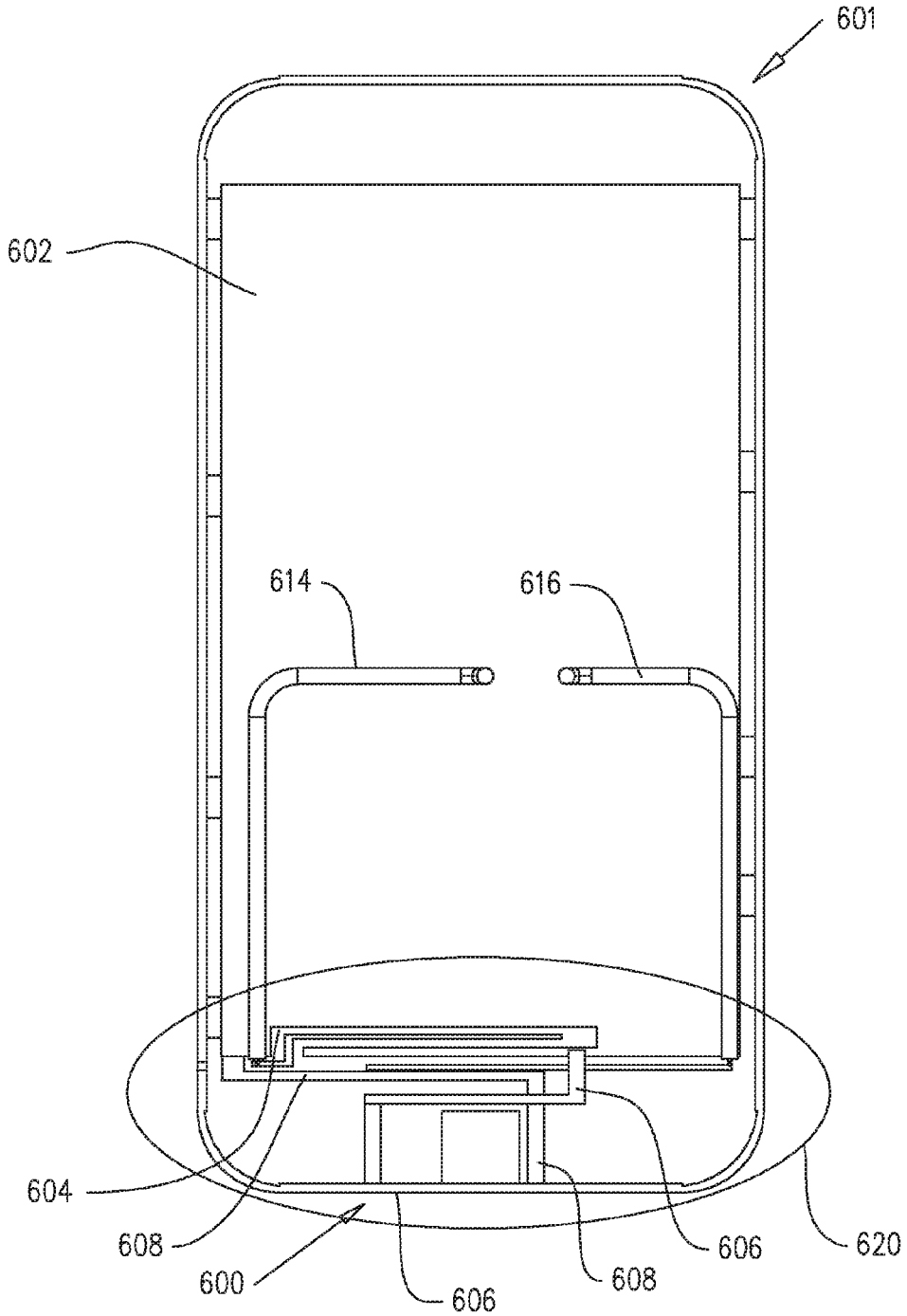
FIGS. 6A, 6B and 6C are simplified respective first and second top and perspective view illustrations of an antenna assembly constructed and operative in accordance with still another preferred embodiment of the present invention.
Figure 6B:
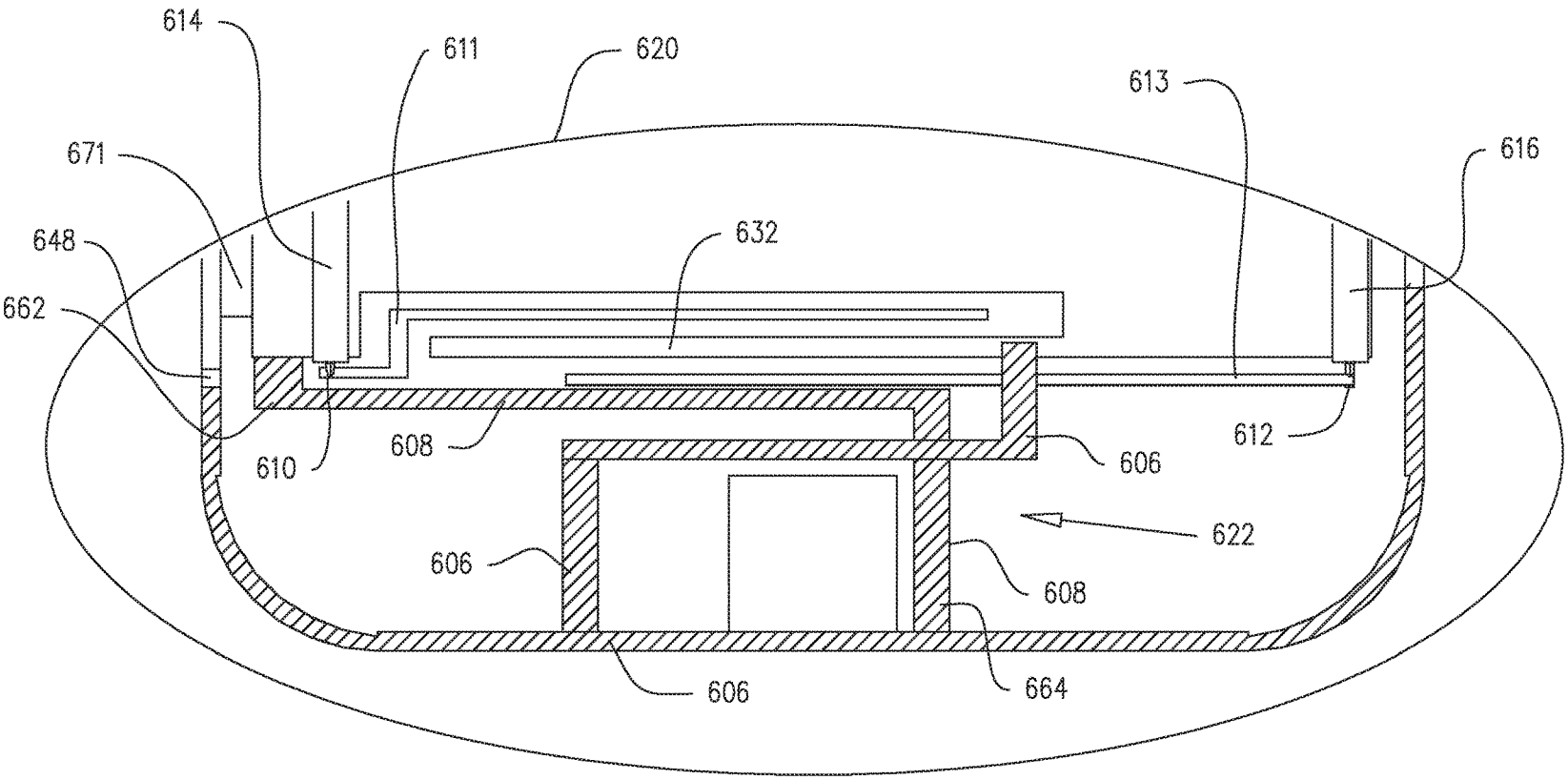
Figure 6C:
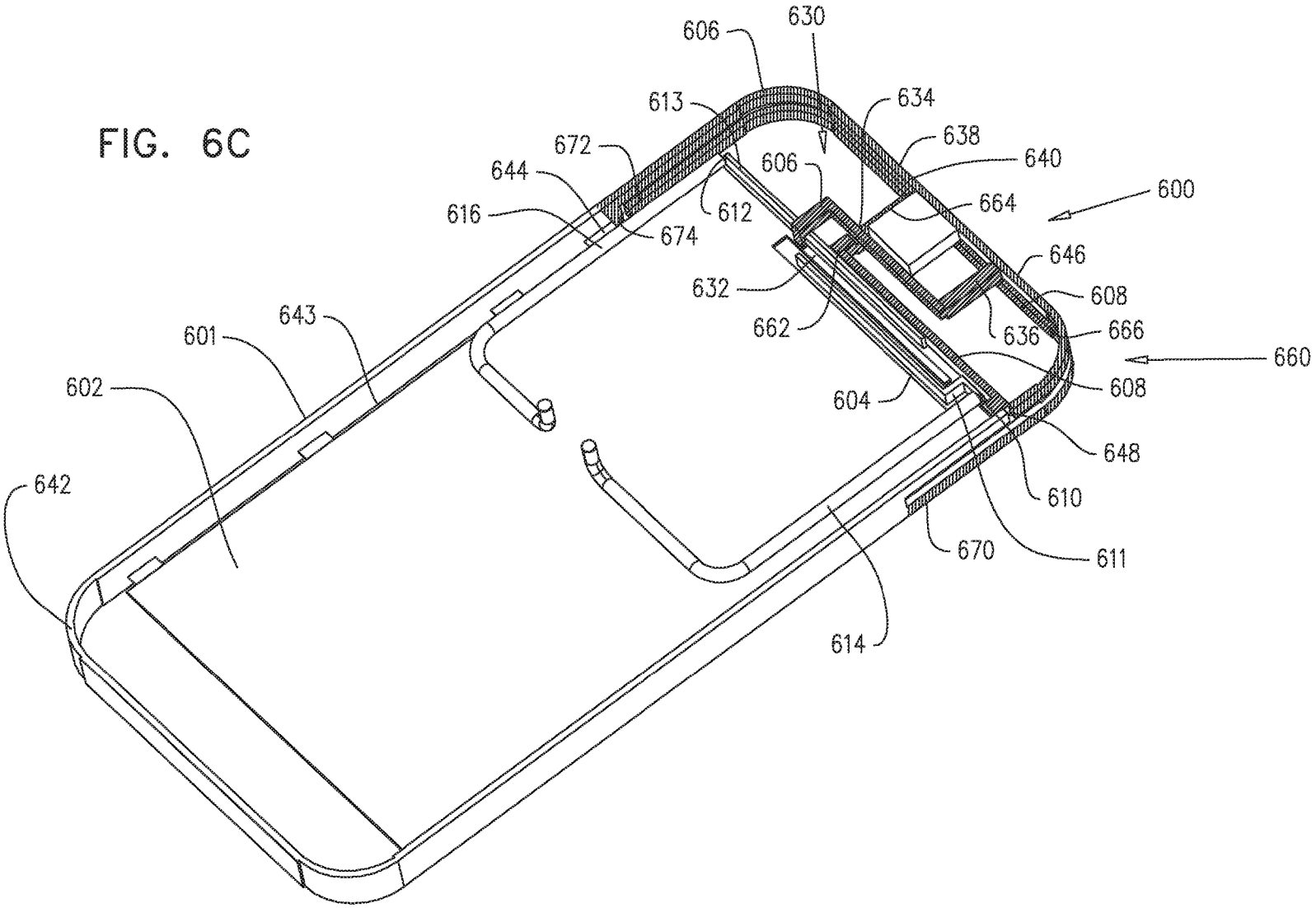

Reference is now made to FIGS. 6A, 6B and 6C, which are simplified respective first and second top and perspective view illustrations of an antenna assembly constructed and operative in accordance with still another preferred embodiment of the present invention.

As seen in FIGS. 6A-6C, there is provided an antenna assembly 600, preferably incorporated into a wireless device 601. Antenna assembly 600 preferably includes a ground element 602 having an edge 604. As seen most clearly in FIG. 6A, ground element 602 preferably lies in a plane defined thereby. In the illustrated embodiment of ground element 602 shown in FIGS. 6A-6C, ground element 602 is shown to be a planar element, the entirety of which element lies in a single plane. It is appreciated, however, that ground element 602 may alternatively comprise non-planar portions, which non-planar portions may extend beyond the plane defined by ground element 602.

A first antenna element 606 and a second antenna element 608 are preferably provided adjacent to edge 604 and coupled thereto. As seen most clearly in FIGS. 6A and 6B, first and second antenna elements 606 and 608 each preferably comprises a loop element, portions of which will be detailed henceforth.

First antenna element 606 is preferably fed by way of a first feed connection 610, preferably embodied as a first elongate feed element 611. Second antenna element 608 is preferably fed by way of a second feed connection 612, preferably embodied as a second elongate feed element 613. First feed connection 612 preferably receives an RF signal by way of a first coaxial cable 614, an inner conductor of which is preferably connected to first elongate feed element 611. Second feed connection 612 preferably receives an RF signal by way of a second coaxial cable 616, an inner conductor of which is preferably connected to second elongate feed element 613. It is appreciated that as a result of first and second antenna elements 606 and 608 being respectively individually fed by first and second feed connections 610 and 612, antenna assembly 600 may be termed a multi-feed antenna assembly.

As best appreciated from consideration of an enlargement 620 in FIG. 6B, first and second antenna elements 606 and 608 each have a projection on the plane defined by ground element 602. It is understood that the projection of first and second antenna elements 606 and 608 on the plane defined by ground element 602 includes the orthogonal transformation of all points along first and second antenna elements 606 and 608 onto the plane defined by ground element 602.

It is a particular feature of a preferred embodiment of the present invention that the projection of second antenna element 608 on the plane defined by ground element 602 is at least partially encompassed by the projection of first antenna element 606 on the plane defined by ground element 602. Here, by way of example, a projection of first antenna element 606 preferably encloses a portion 622 of a projection of second antenna element 608.

As a result of the encompassment of a portion of a projection of second antenna element 608 by a projection of first antenna element 606, wherein the projections of first and second antenna elements 606 and 608 lie on a common plane, multi-feed antenna assembly 600 is extremely compact and occupies only a minimal volume within wireless device 601 in which antenna assembly 600 may be incorporated. This is in contrast to conventional multi-feed antenna assemblies, in which multiple antenna elements fed by individual respective feed connections are typically mutually spatially offset, so as to avoid an overlap of the respective projections thereof and prevent undesirable coupling therebetween.

In operation of antenna assembly 600, first and second feed connections 610 and 612 may respectively simultaneously feed first and second antenna elements 606 and 608.

First antenna element 606 is preferably fed by way of elongate feed element 611. Elongate feed element 611 is preferably narrow and particularly preferably has a width of between approximately $0.0004\lambda$ and $0.0009\lambda$, where $\lambda$ is an operating wavelength of first antenna element 606. In a particularly preferred embodiment of first antenna element 606, elongate feed element 611 may have a width in the range of 0.2 mm-1 mm.

First antenna element 606 preferably includes a loop radiating element 630 preferably coupled to elongate feed element 611. As seen most clearly in FIG. 6C, loop radiating element 630 preferably includes a first portion 632 preferably formed by an extension of ground element 602 and extending generally parallel to elongate feed element 611 and spaced apart therefrom, a second L-shaped portion 634 preferably branching perpendicularly from first portion 632 and a short third portion 636, preferably branching perpendicularly from second portion 634. Loop radiating element 630 further preferably includes a fourth portion 638, which fourth portion 638 is preferably wrapped around first and second portions 632 and 634.

Fourth portion 638 may be formed by an upper segment 640 of a conductive frame 642 of wireless device 601. Conductive frame 642 preferably surrounds a periphery of a body 643 of wireless device 601, within which periphery ground element 602 is preferably disposed. It is appreciated, however, that loop radiating element 630 may alternatively be formed by conductive structures other than a conductive frame of a wireless device and is thus not limited to comprising a portion of conductive frame 642. The conductive path formed by loop radiating element 630 is preferably completed by way of a conductive frame connector 644 seen most clearly in FIG. 6C, and a portion of ground element 602 immediately proximal thereto. It is appreciated that the extent of first antenna element 606 indicated by hatched portions in FIGS. 6A-6C excludes those portions of first antenna element 606 formed by ground element 602, as described above.

First antenna element 606 further preferably includes a fifth portion 646 extending from third portion 636 in a direction away from fourth portion 638. In the embodiment of first antenna element 606 illustrated in FIGS. 6A-6C, fifth portion 646 is shown to be formed by a portion of upper segment 640 of conductive frame 642 and to terminate at a gap 648 in conductive frame 642. It is appreciated, however, that fifth portion 646 of loop radiating element 630 is not restricted to being formed by a portion of conductive frame 642 and may alternatively be formed by alternative conductive structures other than a conductive frame of a wireless device.

It is a particular feature of a preferred embodiment of the present invention that due to the extremely narrow, elongate nature of elongate feed element 611, flanked on one side thereof by edge 604 of ground element 602 and on another side thereof by first portion 632 of loop radiating element 630, elongate feed element 611 in combination with ground element edge 604 and first portion 632 forms a transmission line structure, effectively feeding the remaining portions of loop radiating element 630.

It is a further particular feature of a preferred embodiment of the present invention that as a result of the presence of fourth portion 638 of loop radiating element 630, which fourth portion 638 is preferably wrapped around first and second portions 632 and 634, the impedance matching of loop radiating element 630 to feed element 611 is improved and the need for matching circuits in antenna assembly 600 thereby reduced or obviated.

In the low band of operation of first antenna element 600, loop radiating element 630 acts as a coupling element, transferring RF signal from elongate feed element 611 to the ground element 602. Elongate feed element 611 may be considered to operate as a monopole element in this frequency band and is preferably coupled to the ground element 602. The low band of operation of first antenna element 606 may span a frequency range of approximately 700-1000 MHz.

In the high band of operation of first antenna element 606, second-fifth portions 634-646 serve to create an extremely wide high band of operation of first antenna element 606, panning a frequency range of approximately 1700 to 2700 MHz. The high band of operation of first antenna element 606 thus may be termed a double high band, due to its extremely wide bandwidth.

It is appreciated that, but for the provision of the closed loop portion formed by fourth portion 638, loop radiating element 630 would operate over a relatively narrow bandwidth of approximately 2500-2800 MHz. The presence of the closed loop portion formed by fourth portion 638 of loop radiating element 630 serves to increase the bandwidth without reducing the gain over the high band of operation of first antenna element 606. This is an extremely advantageous result, since in conventional antennas improvement in operating bandwidth is typically accompanied by loss of gain.

Second antenna element 608 is preferably fed by elongate feed element 613, which elongate feed element 613 generally resembles elongate feed element 611. Second antenna element 608 preferably includes a loop radiating element 660 preferably coupled to elongate feed element 613. As seen most clearly in FIG. 6B, loop radiating element 660 preferably includes a first section 662 preferably extending generally parallel to elongate feed element 613 and spaced apart therefrom, a second short section 664 preferably branching perpendicularly from first section 662 and a third section 666, which third section 666 is preferably wrapped around first section 662.

Third section 666 may be formed by a lower segment 670 of conductive frame 642 of wireless device 601. It is appreciated, however, that loop radiating element 660 may alternatively be formed by conductive structures other than a conductive frame of a wireless device and is thus not limited to comprising a portion of conductive frame 642. The conductive path formed by loop radiating element 660 is preferably completed by way of a conductive frame connector 671 and a portion of ground element 602 immediately proximal thereto.

Loop radiating element 660 further preferably includes a fourth section 672 preferably extending from second section 644 in a direction away from third section 666. In the embodiment of second antenna element 608 illustrated in FIGS. 6A-6C, fourth section 672 is shown to be formed by a portion of lower segment 670 of conductive frame 642 and to terminate at a gap 674 in conductive frame 642. It is appreciated, however, that fourth section 672 of loop radiating element 660 is not restricted to being formed by a portion of conductive frame 642 and may alternatively be formed by alternative conductive structures other than a conductive frame of a wireless device. It is further appreciated that the extent of second antenna element 608 indicated by hatched portions in FIGS. 6A-6C excludes those portions of second antenna element 608 formed by ground element 602, as described above.

The operation of second antenna element 608 is generally as described above with reference to first antenna element 606. It is appreciated, however, that whereas gap 648 defining a terminus of fifth portion 646 of first antenna element 606 is preferably located on one side of wireless device 601, gap 674 defining a terminus of fourth section 672 of second antenna element 608 is preferably located on an opposite side of wireless device 601. As a result of the lateral separation of gaps 648 and 674, the respective performances of first and second antenna elements 606 and 608 are preferably differently affected when a user holds wireless device 601, since the user's hand is unlikely to provide the same coverage of both of gaps 648 and 674. First and second antenna elements 606 and 608 may therefore operate in common frequency bands within wireless device 601, wherein the fed antenna element providing superior performance in a predetermined frequency band when wireless device 601 is held by a user, is selected for use.

It is appreciated that the incorporation of first and second antenna elements 606 and 608 in an overlapping volume of wireless device 601 is a highly advantageous feature of a preferred embodiment of the present invention, rendering antenna assembly 600 particularly compact. It is further appreciated that the incorporation of first and second antenna elements 606 and 608 into a common volume of wireless device 601 is facilitated by way of the vertical stacking of first and second antenna elements 606 and 608. The stacking of first and second antenna elements 606 and 608 is preferably achieved by way of the splitting of conductive frame 642 of wireless device 601 into upper and lower segments 640 and 670 and the forming of first and second antenna elements 606 and 608 respectively integrally therewith. It is understood that references herein to upper and lower segments 640 and 670 of conductive frame 642 are relational only and that the respective integration of first and second antenna elements 606 and 608 with upper and lower segments 640 and 670 may be interchanged, without departing from the scope of the present invention.

It is appreciated that the particular illustrated configurations of first antenna element 606 and second antenna element 608 are by way of example only and that the topology and relative placement of first and second antenna elements 606 and 608 may be modified, provided that a projection of second antenna element 608 on the plane defined by ground element 602 remains at least partially encompassed by a projection of first antenna element 606 on that plane.

Reference is now made to FIGS. 7A, 7B, 7C and 7D, which are simplified respective first and second top and front and rear perspective view illustrations of an antenna assembly constructed and operative in accordance with a still further preferred embodiment of the present invention.

As seen in FIGS. 7A-7D, there is provided an antenna assembly 700, preferably incorporated into a wireless device 701. Antenna assembly 700 preferably includes a ground element 702 having an edge 704. As seen most clearly in FIG. 7A, ground element 702 preferably lies in a plane defined thereby. In the illustrated embodiment of ground element 702 shown in FIGS. 7A-7D, ground element 702 is shown to be a planar element, the entirety of which element lies in a single plane. It is appreciated, however, that ground element 702 may alternatively comprise non-planar portions, which non-planar portions may extend beyond the plane defined by ground element 702.

A first antenna element 706 and a second antenna element 708 are preferably provided adjacent to edge 704 and coupled thereto. As seen most clearly in FIGS. 7C and 7D, first and second antenna elements 706 and 708 each preferably comprises a loop element.

First antenna element 706 is preferably fed by way of a first feed connection 710, preferably embodied as a first elongate feed element 711. Second antenna element 708 is preferably fed by way of a second feed connection 712, preferably embodied as a second elongate feed element 713. First feed connection 710 preferably receives an RF signal by way of a first coaxial cable 714, an inner conductor of which is preferably connected to first elongate feed element 711. Second feed connection 712 preferably receives an RF signal by way of a second coaxial cable 716, an inner conductor of which is preferably connected to second elongate feed element 713. It is appreciated that as a result of first and second antenna elements 706 and 708 being respectively individually fed by first and second feed connections 710 and 712, antenna assembly 700 may be termed a multi-feed antenna assembly.

Figure 7A:
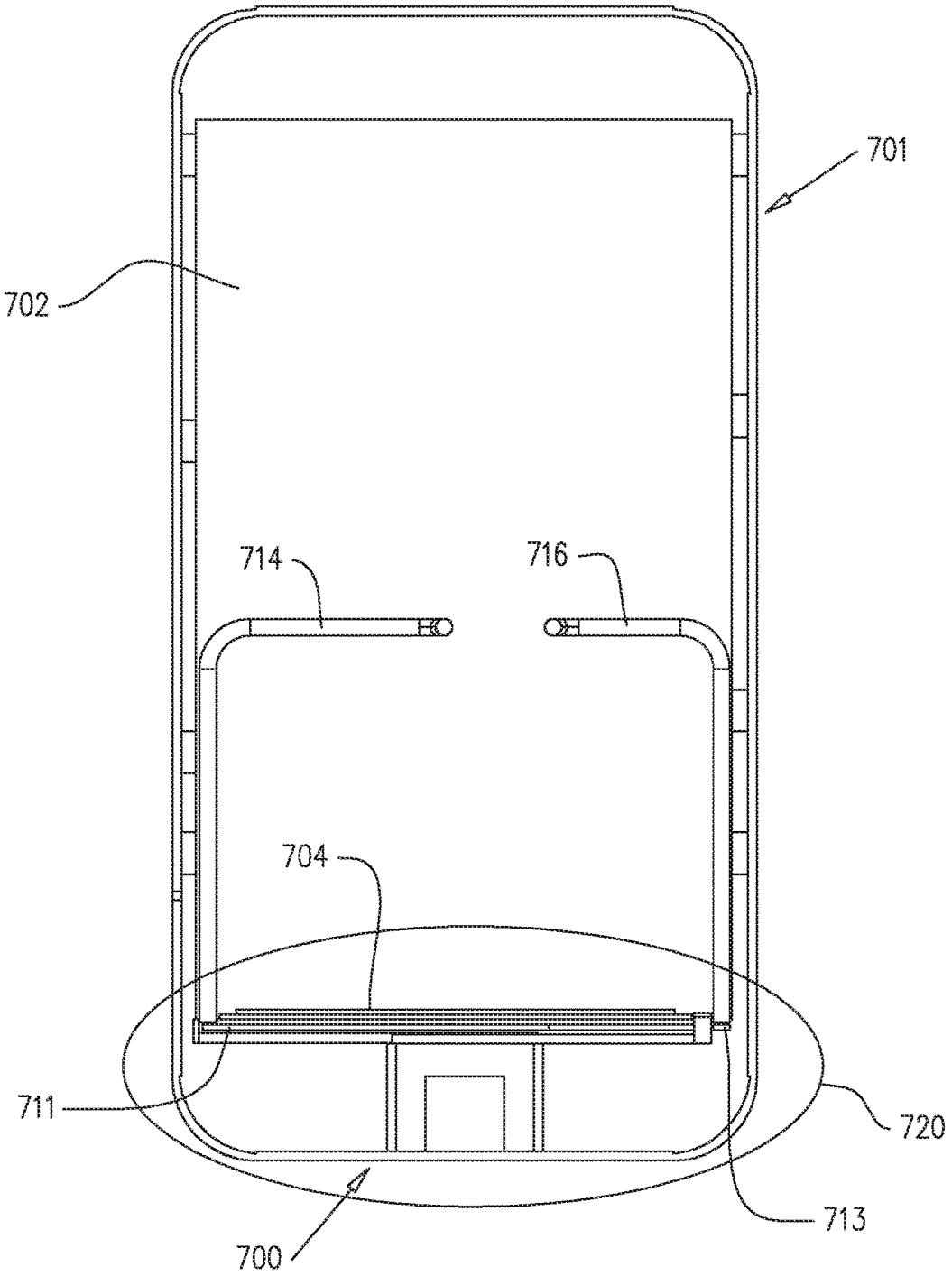
FIGS. 7A, 7B, 7C and 7D are simplified respective first and second top and front and rear perspective view illustrations of an antenna assembly constructed and operative in accordance with a still further preferred embodiment of the present invention.
Figure 7B:
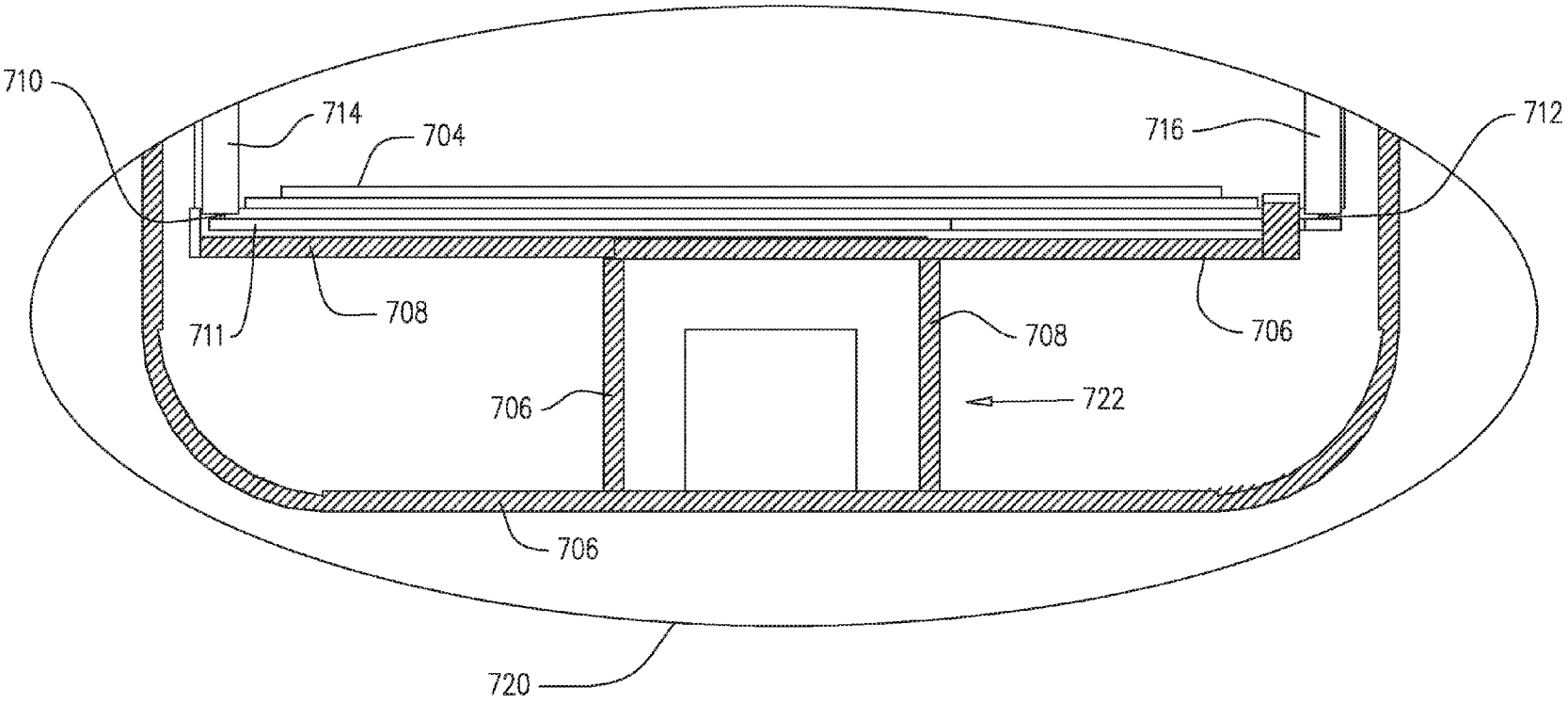
Figure 7C:
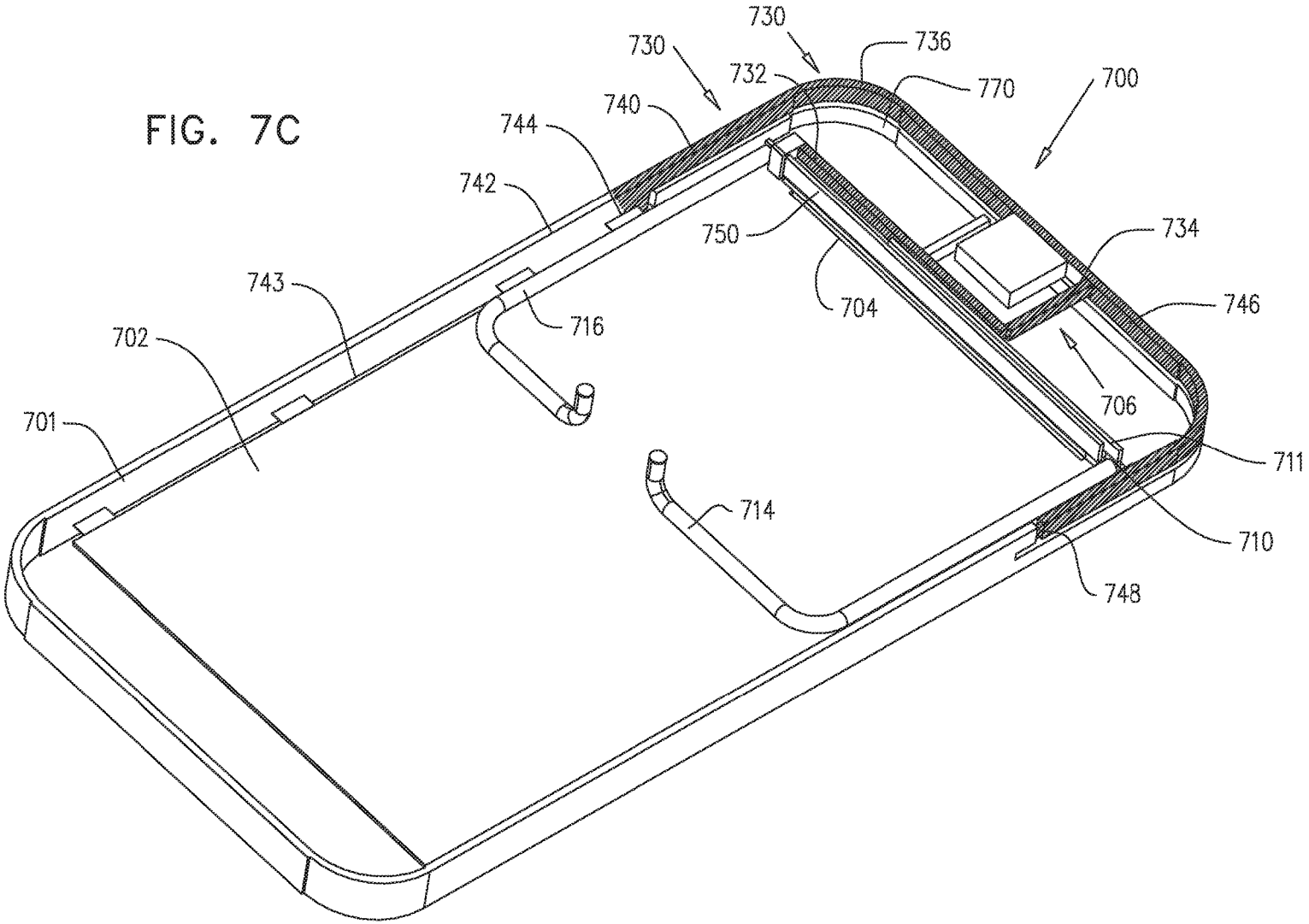
Figure 7D:
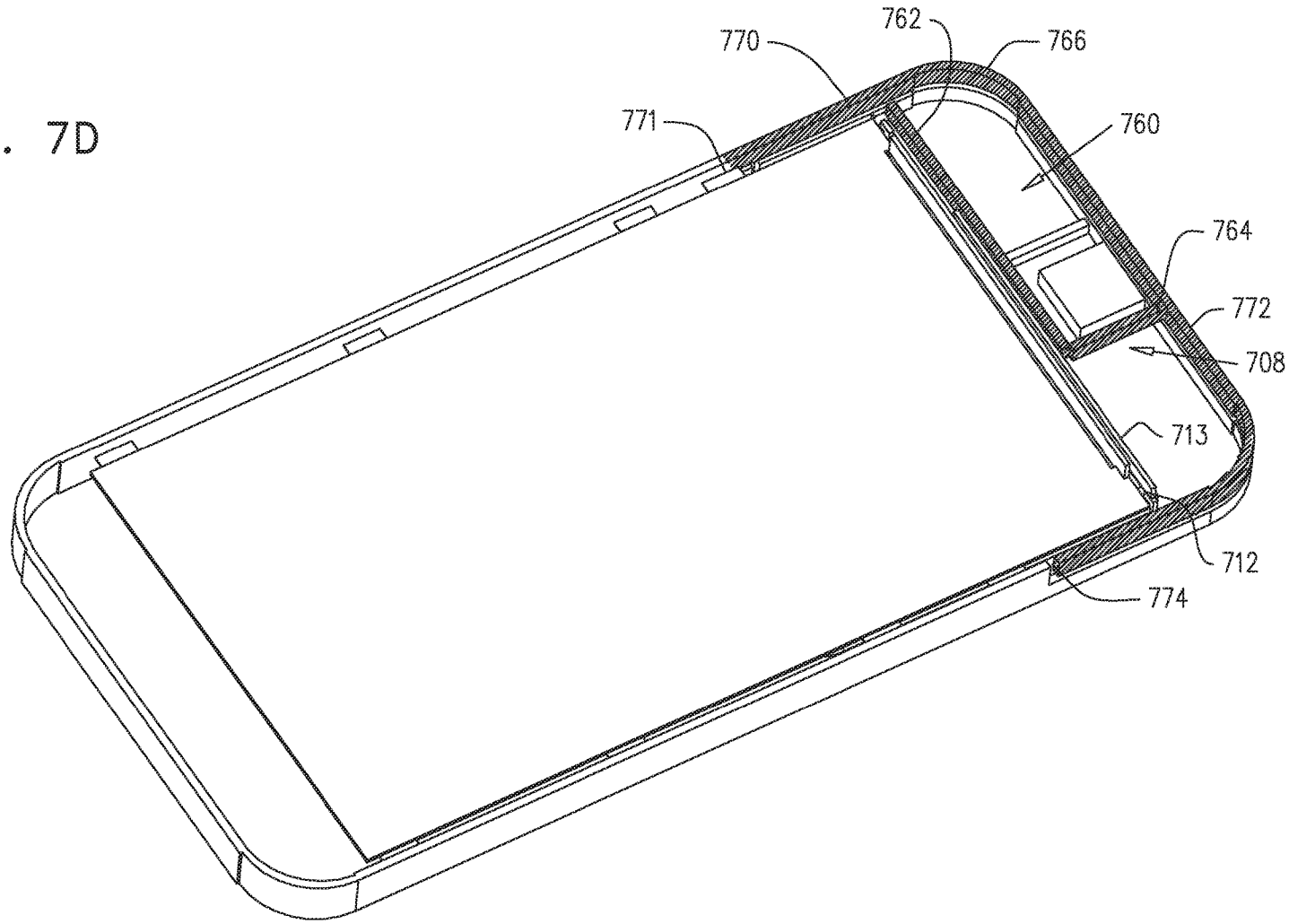

As best appreciated from consideration of an enlargement 720 in FIG. 7B, first and second antenna elements 706 and 708 each have a projection on the plane defined by ground element 702. It is understood that the projection of first and second antenna elements 706 and 708 on the plane defined by ground element 702 includes the orthogonal transformation of all points along first and second antenna elements 706 and 708 onto the plane defined by ground element 702.

It is a particular feature of a preferred embodiment of the present invention that the projection of second antenna element 708 on the plane defined by ground element 702 is at least partially encompassed by the projection of first antenna element 706 on the plane defined by ground element 702. Here, by way of example, a projection of first antenna element 706 preferably encloses a portion 722 of a projection of second antenna element 708.

As a result of the encompassment of a portion of a projection of second antenna element 708 by a projection of first antenna element 706, wherein the projections of first and second antenna elements 706 and 708 lie on a common plane, multi-feed antenna assembly 700 is extremely compact and occupies only a minimal volume within wireless device 701. This is in contrast to conventional multi-feed antenna assemblies, in which multiple antenna elements fed by individual respective feed connections are typically mutually spatially offset, so as to avoid an overlap of the respective projections thereof and prevent undesirable coupling therebetween.

In operation of antenna assembly 700, first and second feed connections 710 and 712 may respectively simultaneously feed first and second antenna elements 706 and 708.

First antenna element 706 is preferably fed by way of elongate feed element 711. Elongate feed element 711 is preferably narrow and particularly preferably has a width of between approximately 0.0004λ and 0.0009λ, where λ is an operating wavelength of first antenna element 706. In a particularly preferred embodiment of first antenna element 706, elongate feed element 711 may have a width in the range of 0.2 mm 1 mm.

First antenna element 706 preferably includes a loop radiating element 730 preferably coupled to elongate feed element 711. As seen most clearly in FIG. 7C, loop radiating element 730 preferably includes a first portion 732 preferably extending generally parallel to elongate feed element 711 and spaced apart therefrom, a second short portion 734, preferably branching perpendicularly from first portion 732 and a third portion 736, which third portion 736 is preferably wrapped around first portion 732.

Third portion 736 may be formed by an upper segment 740 of a conductive frame 742 of wireless device 701. Conductive frame 742 preferably surrounds a periphery of a body 743 of wireless device 701, within which periphery ground element 702 is preferably disposed. It is appreciated, however, that loop radiating element 730 may alternatively be formed by conductive structures other than a conductive frame of a wireless device and is thus not limited to comprising a portion of conductive frame 742. The conductive path formed by loop radiating element 730 is preferably completed by way of a conductive frame connector 744 seen most clearly in FIG. 7C, and a portion of ground element 702 immediately proximal al thereto.

Loop radiating element 730 further preferably includes a fourth portion 746 extending from second portion 734 in a direction away from third portion 736. In the embodiment of first antenna element 706 illustrated in FIGS. 7A-7D, fourth portion 746 is shown to be formed by a portion of upper segment 740 of conductive frame 742 and to terminate at a gap 748 in conductive frame 742. It is appreciated, however, that fourth portion 746 of loop radiating element 730 is not restricted to being formed by a portion of conductive frame 742 and may alternatively be formed by alternative conductive structures other than a conductive frame of a wireless device. It is further appreciated that the extent of first antenna element 706 indicated by hatched portions in FIGS. 7A-7D excludes those portions of first antenna element 706 formed by ground element 702, as described above.

It is a particular feature of a preferred embodiment of the present invention that due to the extremely narrow, elongate nature of elongate feed element 711, flanked on one side thereof by first portion 732 of loop radiating element 730 and on the other side thereof by an extension 750 of ground element 702, elongate feed element 711 in combination with extension 750 of ground element 702 and first portion 732 forms a transmission line structure, effectively feeding the remaining portions of loop radiating element 730.

It is a further particular feature of a preferred embodiment of the present invention that as a result of the presence of third portion 736 of loop radiating element 730, which third portion 736 is preferably wrapped around first portion 732, the impedance matching of loop radiating element 730 to feed element 711 is improved and the need for matching circuits in antenna assembly 700 thereby reduced or obviated.

In the low band of operation of first antenna element 706, loop radiating element 730 acts as a coupling element, transferring RF signal from elongate feed element 711 to the ground element 702. Elongate feed element 711 may be considered to operate as a monopole element in this frequency band and is preferably coupled to the ground element 702. The low band of operation of first antenna element 706 may span a frequency range of approximately 700-1000 MHz.

In the high band of operation of first antenna element 706, first-fourth portions 732-746 serve to create an extremely wide high band of operation of first antenna element 706, spanning a frequency range of approximately 1700 to 2700 MHz. The high band of operation of first antenna element 706 thus may be termed a double high band, due to its extremely wide bandwidth.

It is appreciated that, but for the provision of the closed loop portion formed by third portion 736, loop radiating element 730 would operate over a relatively narrow bandwidth of approximately 2500-2800 MHz. The presence of the closed loop portion formed by third portion 736 of loop radiating element 730 serves to increase the bandwidth without reducing the gain over the high band of operation of first antenna element 706. This is an extremely advantageous result, since in conventional antennas improvement in operating bandwidth is typically accompanied by loss of gain.

Second antenna element 708 is preferably fed by elongate feed element 713, which elongate feed element 713 preferably generally resembles elongate feed element 711. Second antenna element 708 preferably includes a loop radiating element 760 preferably coupled to elongate feed element 713. As seen most clearly in FIG. 7D, loop radiating element 760 preferably includes a first section 762 preferably extending generally parallel to elongate feed element 713 and spaced apart therefrom, a second short section 764 preferably branching perpendicularly from first section 762 and a third section 766, which third section 766 is preferably wrapped around first section 762.

Third section 766 may be formed by a lower segment 770 of conductive frame 742 of wireless device 701. It is appreciated, however, that loop radiating element 760 may alternatively be formed by conductive structures other than a conductive frame of a wireless device and is thus not limited to comprising a portion of conductive frame 742. The conductive path formed by loop radiating element 760 is preferably completed by way of a conductive frame connector 771 and a portion of ground element 702 immediately proximal thereto.

Loop radiating element 770 further preferably includes a fourth section 772 preferably extending from second section 764 in a direction away from third section 766. In the embodiment of second antenna element 708 illustrated in FIGS. 7A-7D, fourth section 772 is shown to be formed by a portion of lower segment 770 of conductive frame 742 and to terminate at a gap 774 in conductive frame 742. It is appreciated, however, that fourth section 772 of loop radiating element 760 is not restricted to being formed by a portion of conductive frame 742 and may alternatively be formed by alternative conductive structures other than a conductive frame of a wireless device. It is further appreciated that the extent of second antenna element 708 indicated by hatched portions in FIGS. 7A-7D excludes those portions of second antenna element 708 formed by ground element 702, as described above.

The operation of second antenna element 708 is generally as described above with reference to first antenna element 706. It is appreciated, however, that whereas gap 748 defining a terminus of fifth portion 746 of first antenna element 706 is preferably located on one side of wireless device 701, gap 774 defining a terminus of fourth section 772 of second antenna element 708 is preferably located on an opposite side of wireless device 701. As a result of the lateral separation of gaps 748 and 774, the respective performances of first and second antenna elements 706 and 708 are preferably differently affected when a user holds wireless device 701, since the user's hand is unlikely to provide the same coverage of both of gaps 748 and 774. First and second antenna elements 706 and 708 may therefore operate in common frequency bands within wireless device 701, wherein the fed antenna element providing superior performance in a predetermined frequency hand when wireless device 701 is held by a user, is selected for use.

It is appreciated that the incorporation of first and second antenna elements 706 and 708 into an overlapping volume in wireless device 701 is a highly advantageous feature of a preferred embodiment of the present invention, rendering antenna assembly 700 particularly compact. It is further appreciated that the incorporation of first and second antenna elements 706 and 708 into a common volume of wireless device 701 is facilitated by way of the vertical stacking of first and second antenna elements 706 and 708. The stacking of first and second antenna elements 706 and 708 is preferably achieved by way of the splitting of conductive frame 742 of wireless device 701 into upper and lower segments 740 and 770 and the forming of first and second antenna elements 706 and 708 respectively integrally therewith. It is understood that references herein to upper and lower segments 740 and 770 of conductive frame 742 are relational only and that the respective integration of first and second antenna elements 706 and 708 with upper and lower segments 740 and 770 may be interchanged without departing from the scope of the present invention.

It is appreciated that the particular illustrated configurations of first antenna element 706 and second antenna element 708 are by way of example only and that the topology and relative placement of first and second antenna elements 706 and 708 may be modified, provided that a projection of second antenna element 708 on the plane defined by ground element 702 remains at least partially encompassed by a projection of first antenna element 706 on that plane.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

What is claimed is:

1. A multi-feed antenna assembly, comprising:

a ground element lying in a plane;

a first antenna element coupled to said ground element and having a projection on said plane;

a first feed for feeding said first antenna element;

a second antenna element coupled to said ground element and having a projection on said plane, said projection of said second antenna element being at least partially encompassed by said projection of said first antenna element;

a second feed for feeding said second antenna element; and a switch galvanically connected to the first feed and the second feed, the switch configured to receive a radio frequency signal and selectively provide the received radio frequency signal to one of the first feed and the second feed.

2. The multi-feed antenna assembly according to claim 1, wherein said first antenna element comprises a PIFA antenna element.

3. The multi-feed antenna assembly according to claim 2, wherein said second antenna element comprises a coupling antenna element.

4. The multi-feed antenna assembly according to claim 1, wherein said first antenna element comprises a coupling antenna element.

5. The multi-feed antenna assembly according to claim 4, wherein said second antenna element comprises a PIFA antenna element.

6. The multi-feed antenna assembly according to claim 1, wherein said first antenna element comprises a monopole antenna element.

7. The multi-feed antenna assembly according to claim 6, wherein said second antenna element comprises a PIFA antenna element.

8. The multi-feed antenna assembly according to claim 1, wherein said first and second antenna elements are disposed on a common surface of a non-conductive carrier.

9. The multi-feed antenna assembly according to claim 1, wherein said first and second antenna elements are disposed on different respective surfaces of a non-conductive carrier.

10. The multi-feed antenna assembly according to claim 1, wherein said first antenna element comprises at least one loop antenna element.

11. The multi-feed antenna assembly according to claim 10, wherein said second antenna element is fully encompassed by said at least one loop antenna element.

12. The multi-feed antenna assembly according to claim 10, wherein said first antenna element is at least partially formed by a conductive frame of a wireless device.

13. The multi-feed antenna assembly according to claim 12, wherein said second antenna element comprises a loop antenna element.

14. The multi-feed antenna assembly according to claim 13, wherein said second antenna element is at least partially formed by a conductive frame of a wireless device.

15. The multi-feed antenna assembly according to claim 14, wherein said second antenna element is stacked upon said first antenna element.

16. The multi-feed antenna assembly according to claim 15, wherein said conductive frame comprises an upper segment and a lower segment, said first antenna element being at least partially formed by said upper segment and said second antenna element being at least partially formed by said lower segment.

17. The multi-feed antenna assembly according to claim 16, wherein said upper segment comprises a first gap and said lower segment comprises a second gap, said first gap forming a terminus of said first antenna element and said second gap forming a terminus of said second antenna element.

18. The multi-feed antenna assembly according to claim 17, wherein said first and second gaps are located on opposite sides of said conductive frame.

19. The multi-feed antenna according to any claim 1, wherein said first antenna element resonates in a first frequency band and said second antenna element resonates in a second frequency band.

20. The multi-feed antenna according to claim 19, wherein said first frequency band overlaps with said second frequency band.

21. A multi-feed antenna assembly, comprising:

a ground element lying in a plane;

at least one first loop antenna element coupled to said ground element and having a projection on said plane;

a first feed for feeding said at least one first loop antenna element;

a second antenna element coupled to said ground element and having a projection on said plane, said projection of said second antenna element being enclosed by said projection of said at least one first loop antenna element; and a second feed for feeding said second antenna element.

22. A device, comprising:

a device body having a periphery;

a conductive frame surrounding said periphery, said conductive frame having an upper segment and a lower segment;

a ground element disposed within said periphery and lying in a plane;

a first antenna element coupled to said ground element and having a projection on said plane, said first antenna element being partially formed by said upper segment;

a first feed for feeding said first antenna element;

a second antenna element coupled to said ground element and having a projection on said plane, said projection of said second antenna element being partially enclosed by said projection of said first antenna element, said second antenna element being partially formed by said lower segment;

a second feed for feeding said second antenna element; and a switch galvanically connected to the first feed and the second feed, the switch configured to receive a radio frequency signal and selectively provide the received radio frequency signal to one of the first feed and the second feed.

* * * * *